US005771651A

United States Patent [19]

Shiina

[11] Patent Number: 5,771,651

[45] Date of Patent: Jun. 30, 1998

[54] FRAMEWORK FOR SMALL-SCALE BUILDING

[76] Inventor: Takaaki Shiina, 473-1, Oaza Ukizuka, Yashio-shi, Saitama-ken, Japan

[21] Appl. No.: 695,395

[22] Filed: Aug. 12, 1996

[30] Foreign Application Priority Data

Nov. 29, 1995 [JP] Japan ..... 7-334054

[51] Int. Cl.[6] ..... E04B 1/344

[52] U.S. Cl. ..... 52/641; 52/646; 52/656.9; 135/143

[58] Field of Search ..... 52/641, 646, 653.1, 52/656.9; 135/122, 143, 147; 403/98

[56] References Cited

U.S. PATENT DOCUMENTS

| | | | |
|---|---|---|---|
| 1,170,188 | 2/1916 | Ramussen et al. | 52/641 |
| 2,334,435 | 11/1943 | Patterson et al. | 135/122 |
| 2,723,673 | 11/1955 | Call | 135/147 X |
| 2,850,027 | 9/1958 | Smith | 135/143 X |
| 5,144,784 | 9/1992 | Marti | 52/646 |
| 5,167,246 | 12/1992 | Mortenson | 135/143 X |
| 5,263,507 | 11/1993 | Chuang . | |

FOREIGN PATENT DOCUMENTS

| | | |
|---|---|---|
| O 534 843 A | 3/1993 | European Pat. Off. . |
| 2-20652 | 2/1990 | Japan . |
| 5-49973 | 7/1993 | Japan . |
| 5-87168 | 11/1993 | Japan . |

*Primary Examiner*—Christopher Kent
*Attorney, Agent, or Firm*—Faegre & Benson LLP

[57] ABSTRACT

A framework for a small-scale building. Specifically, the framework includes four poles, two joint beams, two crossbeams and a ridge beam. The top of each of the four poles is connected with one of the crossbeams and one of the joint beams by a moveable joint. The joint beams are divided at an intermediate point into joint beam portions. The joint beam portions and the ridge beam are connected at the intermediate point with a joint. Further, the crossbeams are divided at an intermediate point into cross beam portions and are connected at this intermediate point with another joint. Finally, the ridge beam is divided at an intermediate point into ridge beam portions and connected at a joint. Each of the joints is bendable, such that the framework may be assembled, folded and stored easily.

7 Claims, 32 Drawing Sheets

FRAMEWORK FOR SMALL-SCALE BUILDING

BACKGROUND OF THE INVENTION

1. Field of the Invention

The present invention relates to a framework for a small-scale building. More particularly, the invention relates to a framework for a tent comprise four poles, joint beams, crossbeams and ridge beams. The disclosed framework provides the advantage of being easy to assemble and fold.

2. Description of the Prior Art

The frameworks of the small scale buildings or tents of the type described herein find wide utility in may applications. For example, these types of tents or small scale buildings may be used as temporary shelter at events such as picnics, family gatherings, weddings, and business meetings. Additionally, these types of buildings may be used as temporary shelter after natural disasters such as earthquakes, tornadoes, floods, etc. Inasmuch as these buildings/tents are intended to be used for temporary shelter, it is desirable that they be easily assembled and disassembled. Furthermore, when disassembled, it is desirable that these structures be compact and lightweight, so as to be easy to store and/or carry.

Many frameworks for small-scale buildings have been described in the prior art. For example, Japanese Laid-Open Patent Application No. Hei 5-49973 discloses a framework for a building (shown in FIG. 63), four poles C separated by distances $L_1$ and $L_2$ respectively, two (or four) crossbeams Ga and Gb and four joint beams Ge and Gf The crossbeams are connected with the joint beams at a three direction joint Ja as shown in FIG. 61, and the joint beams Ge and Gf are connected similarly with the three direction joint Jb. Further, if the crossbeams Ga and Gb are long, they may be divided into two beams Ga and Gb, as shown in FIG. 63, which may be connected as shown in FIG. 62 with joints Jc. Similarly, the ridge beam may be divided into two beams Gc and Gd and connected with joint Jc.

Additionally, Japanese Laid-Open Patent Application No. Hei 5-87168 discloses a framework for a small scale building comprising four poles connected with a building supporter. The building supporter joins each opposite side at the center of each of the sides to result in an assembled figure of four small squares. At the crossing point of the building supporter, a rain avoiding frame is provided. The building supporter comprises two supporting bars crossed in an X-shape, the crossing portion of which is joined with a pin to make a pantograph. Thereby, in order to fold the framework the crossing portion is raised upward along the rain avoiding frame, similar to the action of folding an umbrella. The poles are folded like a pantograph to collect the building supporter.

Finally, Japanese Laid-Open Patent Application No. Hei 2-20652, discloses a framework for a building comprising four poles connected by a plurality of joint beams and crossbeams. The joint beams are connected with a ridge beam, wherein one end of the joint beam is joined rotatably on an upper conical arm and the opposite end of the joint beam is fixed on an under conical arm. Additionally, one end of one pole is rotatably connected to this under conical arm. The crossbeams are attached to holding portions provided on the under conical arm and the ridge beam is attached to holding portions of the upper conical arm.

None of the frameworks disclosed in the prior art provide the desired advantages of such structures without significant concurrent disadvantages. For example, the framework disclosed in Japanese Laid-Open Patent Application No. Hei 5-49973 comprises 17 pieces of hardware and lumber in total; i.e., four poles, four joint beams, at least two crossbeams, at least one ridge beam and two kinds of six joints. Thus, assembly and disassembly of this framework is difficult, time consuming and generally requires more than one person. Additionally, the parts of the disclosed framework are not interchangeable. Thus, fastidious attention must be paid during assembly to ensure that the framework is put together correctly. Furthermore, the structural integrity of the assembled framework is dependent upon the strength of the connection at the joints. Thus, although enough force must be applied to the beams and joints to ensure a firm connection, too much force may result in the bending of the beams, thereby compromising the strength of the assembled framework. Furthermore, the storage of 17 pieces requires a significant amount of space, and inasmuch as nine of these disassembled pieces are relatively small joints, there is a danger of misplacing these necessary parts.

Nor is the framework disclosed in Japanese Laid-Open Patent Application No. Hei 5-87168 without disadvantages. First of all, the framework generally must be folded and constructed without separating the four poles and the rain avoiding frame the portion and thus, when so folded, the framework is too heavy to carry. Further, since in the folded state the rain avoiding frame is projected, and cannot be folded into the profile of the rest of the framework, the folded framework is difficult to transport and store. Finally, the framework lacks sufficient rigidity to be used in a large scale building and is thus inappropriate in many desired applications.

Finally, the framework disclosed in Japanese Laid-Open Patent Application No. Hei 2-20652 is troublesome to assemble and disassemble. That is, although the joint beam and the poles do not have to be separated to be disassembled and folded, the crossbeam and the ridge beam must be separated from the rest of the framework, thus rendering the assembly and disassembly of this framework complex and problematic.

SUMMARY OF THE INVENTION

The present invention provides a framework for a small-scale building. Specifically, the framework comprises poles and beams that are connected with joints. Thus, construction, disassembly and folding and storage of the framework of the present invention are easy. Additionally, since the poles and beams are connected to joints, the problem of the loss of parts is obviated. Finally, the framework of the present invention, when assembled, provides a light-weight, rigid, small-scale building.

Specifically, the framework of the present invention comprises four poles, two joint beams, two crossbeams and a ridge beam. The top portions of the four poles are connected in a movable fashion with two parallel joint beams and two parallel crossbeams. Preferably, the top portions of the poles are connected to joint beams and parallel beams at joints. Additionally, the central portions of said joint beams are connected to the ridge beam in a movable fashion, i.e., at joints. Furthermore, both the ridge beam and the joint beam are divided into two portions which are also connected by a joint, so as to be movable. The joint of the joint beam also serves to connect the joint beam and the ridge beam together. In this manner, the joint beam and crossbeam are capable of being bent downward, and the ridge beam is capable of being bent upward through the joint.

In a preferred embodiment, at the joint connecting the four poles, the joint beams and the crossbeams are connected and two reverse U-letter figured members are provided. The reverse U-letter figured members are combined at right angles with each other and in accordance with the shape of the framework as defined by the joint beam and the cross beam. Thus, the end of the joint beam and the end of the crossbeam, when coupled with the reverse U-letter figured member, are connected. This connection may be fixed by pins that penetrate through the reverse U-letter figured member. In order to guide the placement of the pins, the U-letter figured members preferably comprise apertures. Preferably, the apertures comprise a parallel, or straight, portion that is parallel to the bottom portion of the U-letter figured member. When the pins are guided along the straight portions of the apertures, the upper portions of the joint beams and the crossbeams are maintained in contact with the inner surface of the bottom portion of the reverse U-letter figured member. The apertures preferably further comprise a bent, or curved, portion which, when the pins are guided along the curved portion and the joint beams and crossbeams are bent downward, the ends of the joint beam and the crossbeam are caused to separate from the bottom portion of the reverse U-letter figured member. When so separated, the top portions of the poles are fixed on the reverse U-letter figured member in such a manner the poles are vertically disposed relative to the crossbeams. Also, in this embodiment of the present invention, an additional pin may optionally be provided. Preferably, when the aforementioned pins are in the straight portion of the aperture, the additional pin is positioned so as to be in contact with an under surface of the joint beam and the cross beam.

In yet another embodiment of the invention, the ends of the two-divided joint beams may be clamped with two plates at the joint connection of the joint beams and the ridge beam. The two plates and each end of the joint beams are preferably connected with pins, around which the joint beams may turn. An additional pin is provided, which, when the joint beams are so turned, is guided and displaced in the long apertures provided on two plates, in such a manner as the ends of the joint beams abut or do not abut the pin. Also in this embodiment of the invention, a reverse U-letter figured member is provided that is perpendicular to the sides of two plates. Preferably, a portion at the bottom of this U-letter figured member is cut out. In this manner, the ends of the ridge beams may be connected with pins. Specifically, when the ridge beams are horizontal, a pin in contact with the under edge of the ridge beams penetrates the cut out portion of the U-letter figured member. Such a pin would be located at an inner position of the framework relative to other pins which connect the ridge beam.

According to another embodiment of the present invention, the divided ends of the ridge beam may be coupled with a reverse U-letter figured member and connected with a pin penetrating the reverse U-letter figured member. It is preferred that both sides of the reverse U-letter figured member comprise long apertures to guide the pin. His further preferred that the apertures consist of parallel portions, which are parallel to the bottom portion of the reverse U-letter figured member, and bent portions. In the state where the ridge beam is horizontal and the pin is guided through the parallel portion of the aperture, the upper surfaces of the ridge beams would be brought into contact with the inner side of the bottom portion of the reverse U-letter figured member. Alternatively, if the pin is guided through the bent portions of the aperture and the ridge beam is bent at the joint portion, the ends of the ridge beam separate from the bottom portion of the reverse U-letter figured member.

In another embodiment of the present invention, a pin may be provided that is in contact with the under surface of the ridge beam while also penetrating the reverse U-letter figured member. Preferably, this pin is provided when the upper surfaces of the ridge beam are in contact with the bottom portion of the reverse U-letter figured member, as when the pin is guided along the parallel portions of the aperture.

In yet another embodiment of the present invention, the ends of the two divided crossbeams may be coupled with a reverse U-letter figured member. Preferably, one part of the bottom portion of the reverse U-letter figured member would be cut out so as to allow the ends of the crossbeams to be connected with a pin. In this embodiment of the invention, the crossbeams are preferably able to rotate about the pin. Furthermore, the ends of the crossbeams may thus be engaged or disengaged with the pin, i.e., or when the pin is displaced from the long apertures provided on both sides of the reverse U-letter figured member.

In a preferred embodiment, the framework of the present invention may be constructed as follows. The tops of the four poles are connected to the two parallel joint beams by the joints. The ridge beam, which is divided into two and connected by ajoint, is connected through the joints at the central portions of the joint beams. The cross beam is divided into two and connected with ajoint. Additionally, the joint beams are divided into two. The divided joint beams and the ridge beam are connected with common joints. By virtue of the connection by a joint, the two-divided joint beams are bendable in a downward direction through each joint. Analogously, the two-divided ridge beams are bendable in an upward direction through each joint. Thus, in the embodiment of the invention where each pole and each beam are connected through a joint, the two-divided joint beams and two-divided crossbeams can be bent downward through every joint, and the ridge beam may be bent upward. When bent in this manner, the framework is folded in a manner such that the crossbeams, poles, and ridge beams come close to each other.

Alternatively, when the ends of the joint beams and the ends of the crossbeams are formed by combining two reverse U-letter figured members, i.e., when the joint and the crossbeam are at right angles in the plane of the building, a rigid connection between the joint beams and the crossbeams is obtained, and thus, a structure in accordance with this embodiment of the invention may also be made rigid. However, though rigid, the joint beams and the crossbeams remain bendable in a downward direction.

In this embodiment of the invention, a pin is provided on the ends of the joint beams and the crossbeams that penetrates the reverse U-letter figured member. Preferably, the U-letter figured member comprises apertures to guide the pin which comprise of a parallel portion parallel to the bottom portion of the reverse U-letter figured member. The parallel portion of the aperture serves to guide the pin in such a manner that the upper surfaces of the joint beams and the crossbeams are maintained in contact with the inner side of the bottom portion of the reverse U-letter figured member. The aperture further comprises a bent portion which serves to guide the pin in such a manner that the ends of the joint beams and the crossbeams, when the joint beams and the crossbeams are bent downward, separate from the bottom portion of the reverse U-letter figured member. In other words, in the state where the framework is constructed, the upper surfaces of the joint beams and the crossbeams are in contact with the inner side of the bottom portion of the reverse U-letter figured member. If the pin is located at the parallel portion of the aperture, the joint beams and crossbeams will resist bending, i.e., the structure will be rigid. If, on the other hand, the pin is located along the bent portion of the aperture, the joint beams and the crossbeams will be bendable in a downward direction.

Also, by fixing the poles at the top on the reverse U-letter figured member vertically downward, the joints on the tops of the poles are fixed so as to provide a rigid framework. Thus, without removing the joints from the tops of the poles, the joint beams and the crossbeams can be folded at the joint, in order to make the joint beams and the crossbeams come close to the poles.

In an alternative embodiment of the present invention, the ends of the joint beams and the ends of the crossbeams may be clamped. Specifically, the pin may be guided along the aperture while the upper surfaces of the joint beams and the crossbeams are in contact with the bottom of the reverse U-letter figured member. An additional pin is then provided which is in contact with the under surfaces of the joint beams and the crossbeams while also penetrating the reverse U-letter figured member. In this manner, the ends of the joint beams and the crossbeams are clamped when the framework is constructed, i.e., the crossbeams and joint beams are not bendable in a downward direction. When the crossbeams and joint beams are so configured, any force acting so as to cause the reverse U-letter figured member to be broadened by a horizontal direction force or three dimensional torsion is absorbed by the tensile strength of the constructed framework.

Furthermore, in an additional embodiment of the invention, the joint beams may be constructed so as to be bendable both in an upward and downward direction. Specifically, the joint portion which connects the ends of two-divided joint beams and the ridge beam to each other and the ends of the joint beams may comprise two sheet of plates connected with a pin. Preferably, the two-divided joint beams are capable of pivoting around the pin, and thus the two-divided joint beams can be folded upward or downward. Additionally, a pin may be provided, which is guided and displaced in the long apertures provided on two plates, in such a manner as the ends of the joint beams abut or do not abut the pin. In the state where the pin is displaced along the long aperture and the ends of the joint beams abut, i.e., when the framework is constructed, the bending of the joint beams is restricted. Alternatively, when the pin is displaced along the long aperture and the ends of the joint beams do not abut, the joint beams may be bent is a downward direction.

Furthermore, a reverse U-letter figured member is provided perpendicular to the sides of the two plates. Preferably, at the end portion of the U-letter figured member, one part of the bottom portion of the reverse U-letter figured member is cut out. At this cut-out portion, the end of the ridge beam may be coupled and connected with a pin, thereby providing a common joint between the joint beams and the ridge beam. As a result, the ridge beam may be bent upward without abutting to the bottom portion of the reverse U-letter figured member.

Additionally, in the state where the ridge beams are horizontal, i.e., when the framework is constructed, a pin may be provided about which the ridge beam may be bent and the force of such bending may be absorbed by the pin. Specifically, a pin may be provided which is in contact with the under surface of the ridge beam while penetrating the cut out portion of the bottom portion. Preferably, the pin is located at a position to the inside of the pins that connect the ridge beam. In this manner, the force acting to cause the ridge beam to be bent downward is absorbed by this pin. Analogously, any force acting to cause the ridge beam to be bent upward is also absorbed by this pin.

In yet another embodiment of the present invention, the two-divided ridge beam may be provided so as to be bendable. Specifically, the two-divided ridge beam may be made bendable by coupling the ends of two-divided ridge beam with the reverse U-letter figured member and connecting this reverse U-letter figured member with a pin penetrating the reverse U-letter figured member. In so doing, not only does the bending of two-divided ridge beam become possible, but the rigidity of the framework is increased by unification of the ridge beam and the reverse U-letter figured member. Furthermore, the reverse U-letter figured member has provided on both sides thereof long apertures to guide the pin. These long apertures comprise, in the state where the ridge beam is horizontal, a parallel portion parallel to the bottom portion of the reverse U-letter figured member to guide the pin in a manner such that the upper surface of the ridge beam is maintained in contact with the inner side of the bottom portion of the reverse U-letter figured member. The apertures further comprise, in the state where the ridge beam is bent downward at the joint portion, a bent portion to guide the pin in a manner such that the end of the ridge beam separates from the bottom portion of the reverse U-letter figured member. In this manner, the downward bending of the ridge beam is restricted, i.e. the ridge beam may only be bent upward.

Alternatively, if the pin is guided in the parallel portion of the long apertures and the upper surfaces of the ridge beam are in contact with the bottom portion of the reverse U-letter figured member, the framework may be made rigid. Specifically, a pin is provided that is in contact with the under surfaces of the ridge beam while penetrating the reverse U-letter figured member. In this manner, the connection of ends of the two-divided ridge beam is made resistant to the force downward. Furthermore, any horizontal force to broaden that is applied to this portion of the framework would be absorbed by the pin.

In another embodiment of the invention, a portion of the reverse U-letter figured member is cut out and the ends of the crossbeams are connected to each other within the cut-out portion, making it possible to bend the two-divided crossbeam. Furthermore, resistance against the horizontal force to broaden or three dimensional torsion of the reverse U-letter figured member is so provided. Additionally, a pin may be provided that is guided and displaced in the long apertures provided on the sides of the reverse U-letter figured member. Preferably, the pin is placed in such a manner that, when the crossbeams pivot about the pin, the ends of the crossbeam change to abut and not to abut the pin.

Referring now to FIGS. 1 and 2, the top portions of four poles C are connected with two sets of parallel joint beams, each set of which consists of two joint beams G1 and G2 and two sets of crossbeams, each set of which consists of two crossbeams G3 and G4. The top portions of four poles C are connected to joint beams G1 and G2 and crossbeams G3 and G4 through joints J1 and J2. Two joint beams G1 and G2 are connected with ridge beams G5 and G6 through ajoint J3. Two-divided ridge beams G5 and G6 are connected with ajoint J5 and two-divided crossbeams G3 and G4 are connected with ajoint J4. Two-divided joint beams G1 and G2 and two-divided crossbeams G5 and G6 are connected with a common joint J3. Two-divided joint beams G1 and G2 and the crossbeams G3 and G4 are bendable downward through joints J3 and J4 as shown in the direction of an arrow (a) in FIG. 1 and arrow (b) in FIG. 2. Further, two-divided ridge beams G5 and G6 are bendable upward through the joint J5 as shown in the direction of an arrow (c) in FIG. 2.

Within joints J1 and J2, which connect the tops of poles C of FIG. 1, the ends of joint beams G1 and G2 and the ends of crossbeams G3 and G4, as shown in FIG. 9, are combined at right angles to each other and the plane of the framework. As shown in FIG. 13, the ends of joint beams G1 and G2, and crossbeams G3 and G4 are joined into reverse U-letter figured members 1 and 2.

The ends of joint beams G1 and G2 and crossbeams G3 and G4 are connected to reverse U-letter figured members 1 and 2 by pins 3 and 4 which penetrate reverse U-letter figured members 1 and 2. Both sides of reverse U-letter figured members 1 and 2 are provided with long apertures 5 and 6 which act to guide pins 3 and 4, as shown in FIGS. 11 and 12. Long apertures 5 and 6 comprise parallel portions 501 and 601 parallel to bottom portions 101 and 201 of reverse U-letter figured members 1 and 2, which guide pins 3 and 4 in such a manner that pins 3 and 4 slide in contact with the inner side of bottom portions 101 and 201 of reverse U-letter figured members 1 and 2. Long apertures 5 and 6 further comprise bent portions 502 and 602 which guide pins 3 and 4 in such a manner that when bending joint beams G1 and G2 and crossbeams G3 and G4 downward, the ends of joint beams G1 and G2 and crossbeams G3 and G4 separate from bottom portions 101 and 201 of reverse U-letter figured members 1 and 2. As shown in FIGS. 14 and 15, the tops of poles C are fixed on reverse U-letter figured member 2 so as to position the tops of poles C downward vertically relative to crossbeams G3 and G4.

Referring now to FIGS. 14 and 15, pins 3 and 4 are guided along parallel portions 501 and 601 of long apertures 5 and 6. In the position where the upper portions of joint beams G1 and G2 and crossbeams G3 and G4 are in contact with the bottom portions 101 and 201 of the reverse U-letter figured members 1 and 2, pins 7 and 8 are provided. Pins 7 and 8 maintain contact with the under surfaces of joint beams G1 and G2 and crossbeams G3 and G4 while penetrating reverse U-letter figured members 1 and 2.

In the joint portion, where the ends of joint beams G1 and G2 and the ends of ridge beams G5 and G6 are connected to each other, as shown in FIG. 16, the ends of two-divided joint beams G1 and G2 are clamped with two plates 9 and 10. Plates 9 and 10 and each end of joint beams G1 and G2 are connected with pin 11 as shown in FIG. 19. Pin 13 is provided, which is guided and displaced along the long apertures 12 on two plates 9 and 10. Preferably, pin 13 is placed such that when joint beams G1 and G2 pivot around pin 11, the ends of joint beams G1 and G2 move to abut or not to abut pin 13. Further, as shown in FIGS. 16 and 17, a reverse U-letter figured member 14 is provided that is perpendicular to the sides of plates 9 and 10. At the tip end of reverse U-letter figured member 14, as shown in FIGS. 16 and 18, a cut out portion 15 is provided which is formed by cutting out one part of the bottom portion of reverse U-letter figured member 14. As shown in FIG. 19, the ends of the ridge beams G5 and G6 are coupled and connected within cut out portion 15 by pin 16. As shown in FIGS. 18 and 19, when the ridge beams G5 and G6 are horizontal, a pin 17 is provided that contacts the under sides of ridge beams G5 and G6 while also penetrating cut out portion 15 of reverse U-letter figured member 14. Pin 17 is located, as shown in FIG. 18, to the inside of the framework relative to pin 16.

As shown in FIG. 23, in joint J5 of two-divided ridge beams G5 and G6, the divided ends of ridge beams G5 and G6 are coupled with reverse U-letter figured member 18. Ridge beams G5 and G6 are connected by pin 19 which penetrates reverse U-letter figured member 18. Long apertures 20 are provided on both sides of reverse U-letter figured member 18 to guide pin 19. Long apertures 20 comprise a parallel portion 201 parallel to the bottom portion 181 of reverse U-letter figured member 18. Parallel portion 201 guides pin 19 in a manner such that the upper surface of ridge beams G5 and G6 is maintained in contact with inner surface of bottom portion 181 of reverse U-letter figured member 18. Long apertures 20 further comprise bent portion 202 which guides pin 19 in a manner such that the ends of ridge beams G5 and G6 separate from bottom portion 181 of reverse U-letter figured member 18 ridge beams G5 and G6 are bent at the joint J5.

Referring now to FIG. 23, where the upper surfaces of ridge beams G5 and G6 are in contact with bottom portion 181 of reverse U-letter figured member 18 by virtue of pin 19 being guided along parallel portion 201 of long aperture 20, pin 21 is provided. Pin 21 is in contact with the under sides of ridge beams G5 and G6 while penetrating reverse U-letter figured member 18.

Referring now to FIGS. 20 and 21, the ends as shown in FIG. 1 of crossbeams G3 and G4 are coupled to each other with reverse U-letter figured member 22. The bottom portion of reverse U-letter figured member 22 is cut out to form cut-out portion 23, wherein the ends of crossbeams G3 and G4 are connected with pin 24. Pin 26 is provided on the side of the reverse U-letter figured member 22, in a manner such that, when crossbeams G3 and G4 pivot around pin 24, the ends of crossbeams G3 and G4 move to abut or not to abut pin 26.

DETAILED DESCRIPTION OF THE INVENTION

Referring once again to FIG. 1, there is illustrated one embodiment of the present invention. At the tops of four poles C, two sets of parallel joint beams G1 and G2 and two sets of parallel crossbeams G3 and G4 are connected through joints J1 and J2. Joint beams G1 and G2 are connected to ridge beams G5 and G6 through joint J3. Two-divided ridge beams G5 and G6 are connected with joint J5, two-divided crossbeams G3 and G4 are connected with two joints J4. Two joint beams G1 and G2 and two-divided ridge beams G5 and G6 are connected with common joint J3.

Figure 1:
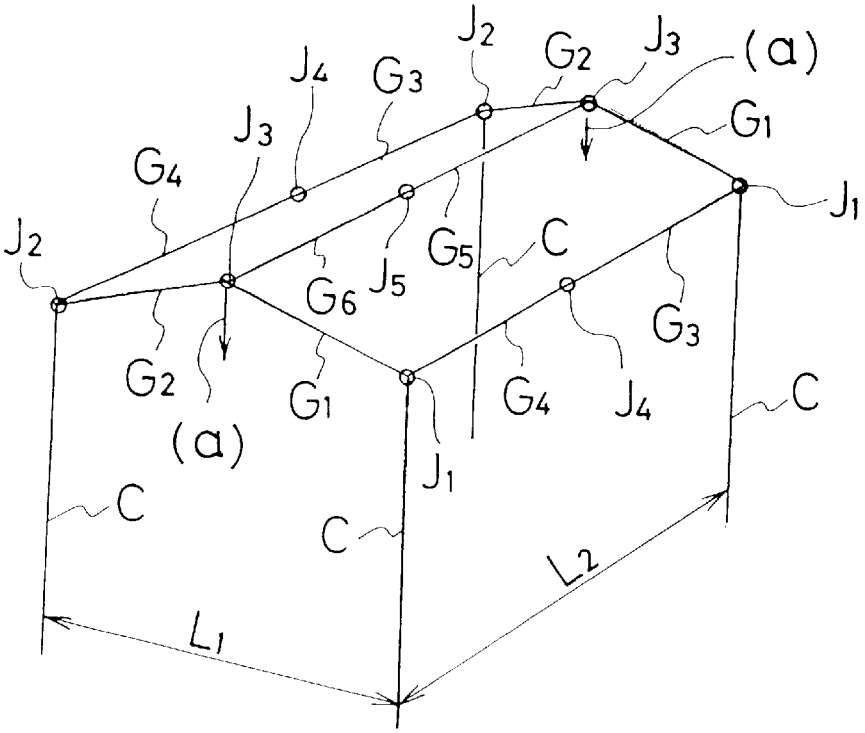
FIG. 1 is a perspective view of a framework for a building according to one embodiment of the present invention.

Joint beams G1 and G2 may be bent downward at joint J3 in the direction of arrow (a) in FIG. 1. Crossbeams G3 and G4 may be bent at the joint J4 in the direction of arrow (b) in FIG. 2. Joints J1 and J2 are connected at the tops of poles C. Further, at joint J3 two joint beams G1 and G2 may be bent downward in the direction of arrow (a) in FIG. 1. The ridge beams G5 and G6 are adapted to be bent upward in the direction of arrow (c) in FIG. 2 at joint J5. Next, at joint J4, two ends of crossbeams G3 and G4 are connected and adapted to be bent downward in the direction of arrow (b) in FIG. 2. At joint J5, two ends of ridge beams G5 and G6 are connected and adapted to be bent upward in the direction of arrow (c) in FIG. 2.

Figure 10:
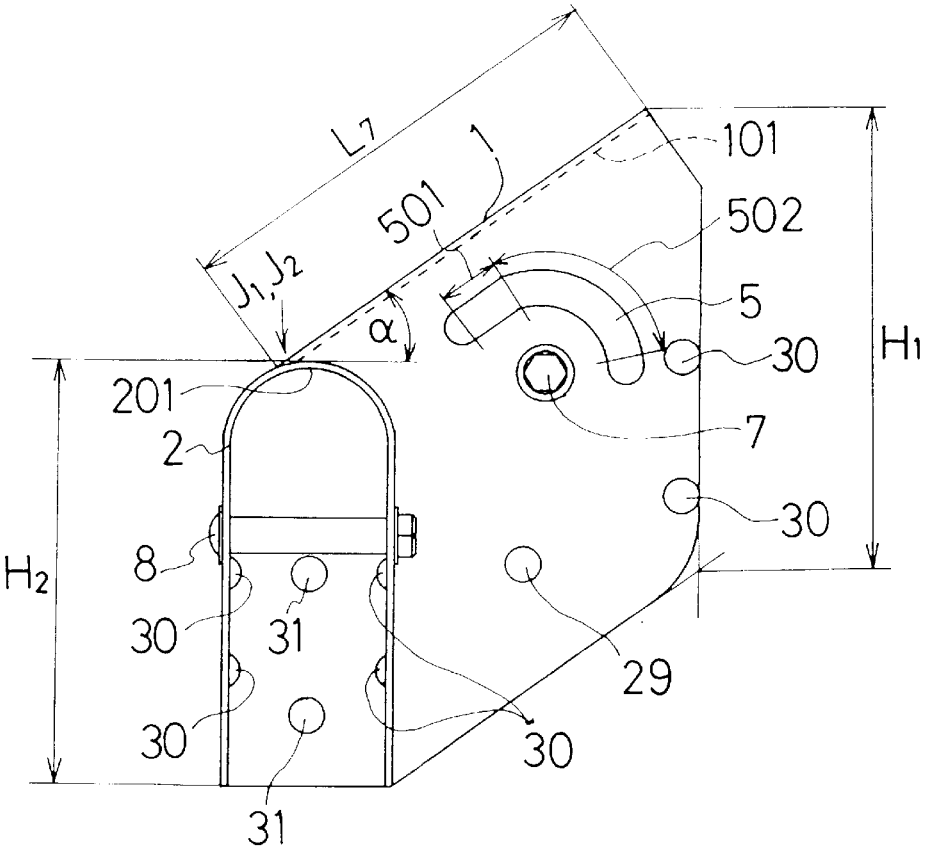
FIG. 10 is a front view of FIG. 9.

Each joint will now be explained in more detail. First, as to joints J1 and J2, in the embodiment shown in FIG. 13, joint beams G1 and G2 and crossbeams G3 and G4 are made of pipe. Joints J1 and J2 are structured, as shown FIGS. 10 and 11, in the form of reverse U-letter figured members 1 and 2. Further, as shown in FIG. 10, reverse U-letter figured member 1 is fixed to the reverse U-letter figured member 2 which connects crossbeams G3 and G4.

Figure 11:
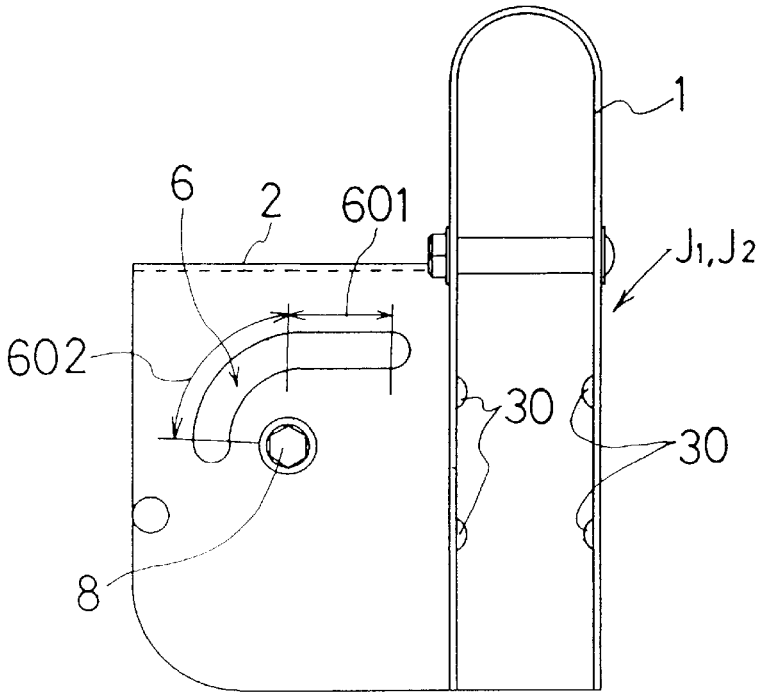
FIG. 11 is a right side view of FIG. 9.
Figure 12:
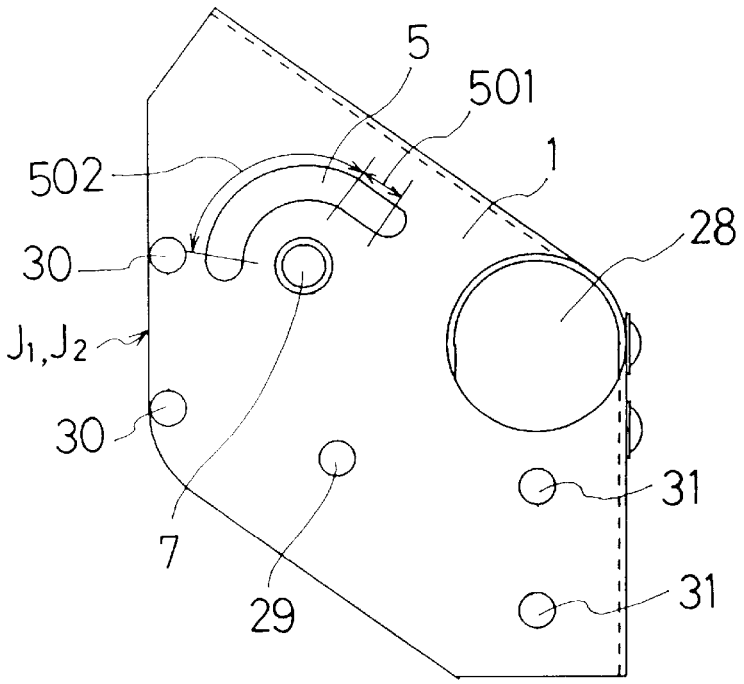
FIG. 12 is a left side view of FIG. 9.
Figure 13:
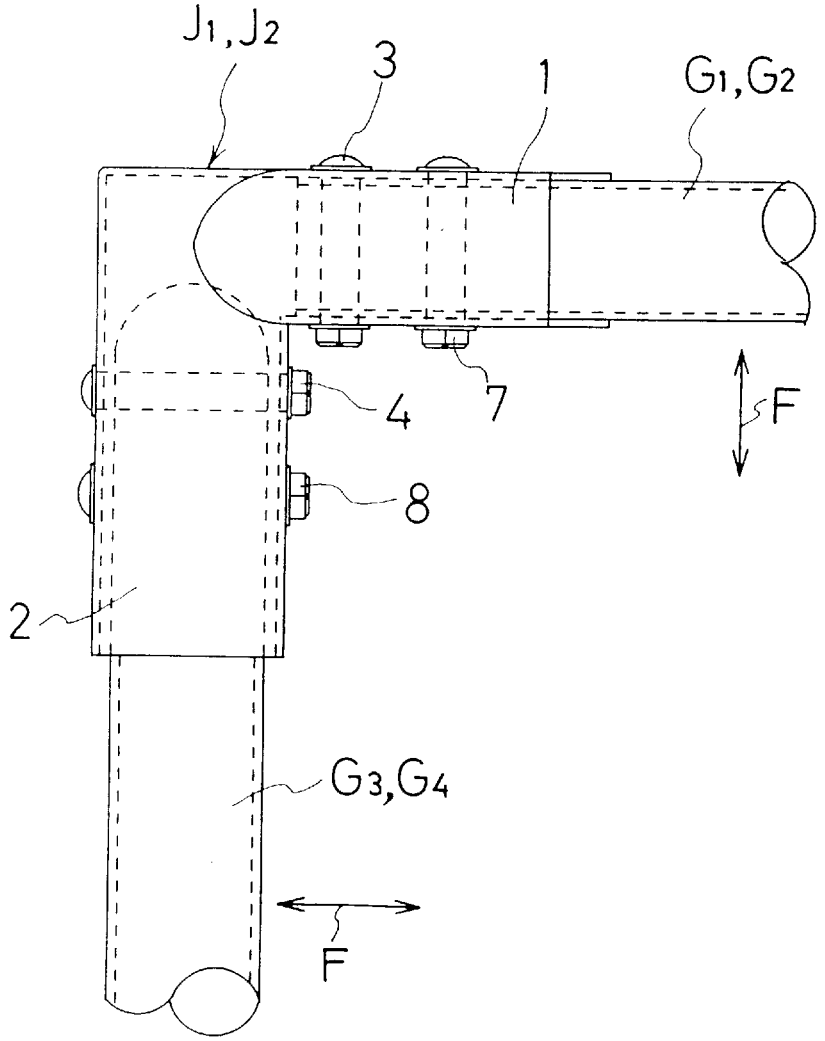
FIG. 13 is a plan view showing the state in which ajoint beam and a crossbeam are coupled with the joint in FIG. 9.

FIG. 13 shows a plan view in which joint beams G1 and G2 are connected to reverse U-letter figured member 1 and crossbeams G3 and G4 are connected to reverse U-letter figured member 2. Both ends of joint beam G1 or G2 and the crossbeam G3 or G4 are penetrated by pins 3 and 4. Pin 3 and 4 further penetrate through reverse U-letter figured members 1 and 2 so that joint beams G1 and G2 and crossbeams G3 and G4 may pivot about pins 3 and 4. As shown in FIGS. 10–12, both sides of each reverse U-letter figured members 1 and 2 comprise long apertures 5 and 6 that function to guide pins 3 and 4.

Figure 14:
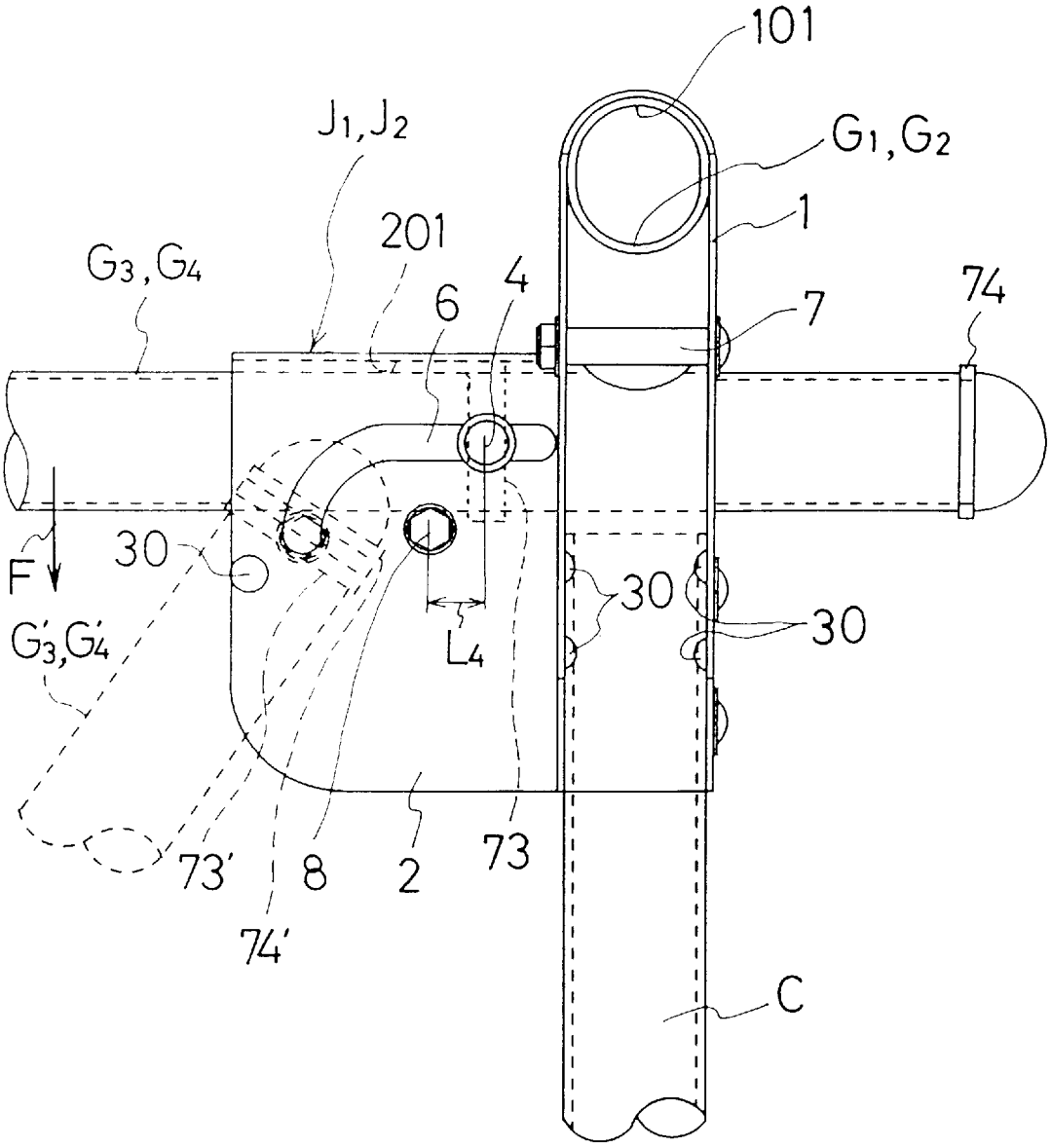
FIG. 14 is a right side view of FIG. 13.

The configuration of long aperture 6 comprises, in the state of assembling the framework, a parallel portion 601 (FIG. 11) parallel to bottom portion 201 of reverse U-letter figured member 2, as shown in FIG. 14, in order to guide pin 4 along the inside of long aperture 6 in a manner such that the upper surfaces of crossbeams G3 and G4 are maintained in contact with bottom portion 201 of reverse U-letter figured member 2. Long aperture 6 further comprises a bent portion 602 in order to guide pin 4 in a manner such that pin 4 guides crossbeams G3 and G4 to separate from bottom portion 201 of reverse U-letter figured member 2 when crossbeams G3 and G4 are bent downward as shown in FIG. 14.

Figure 15:
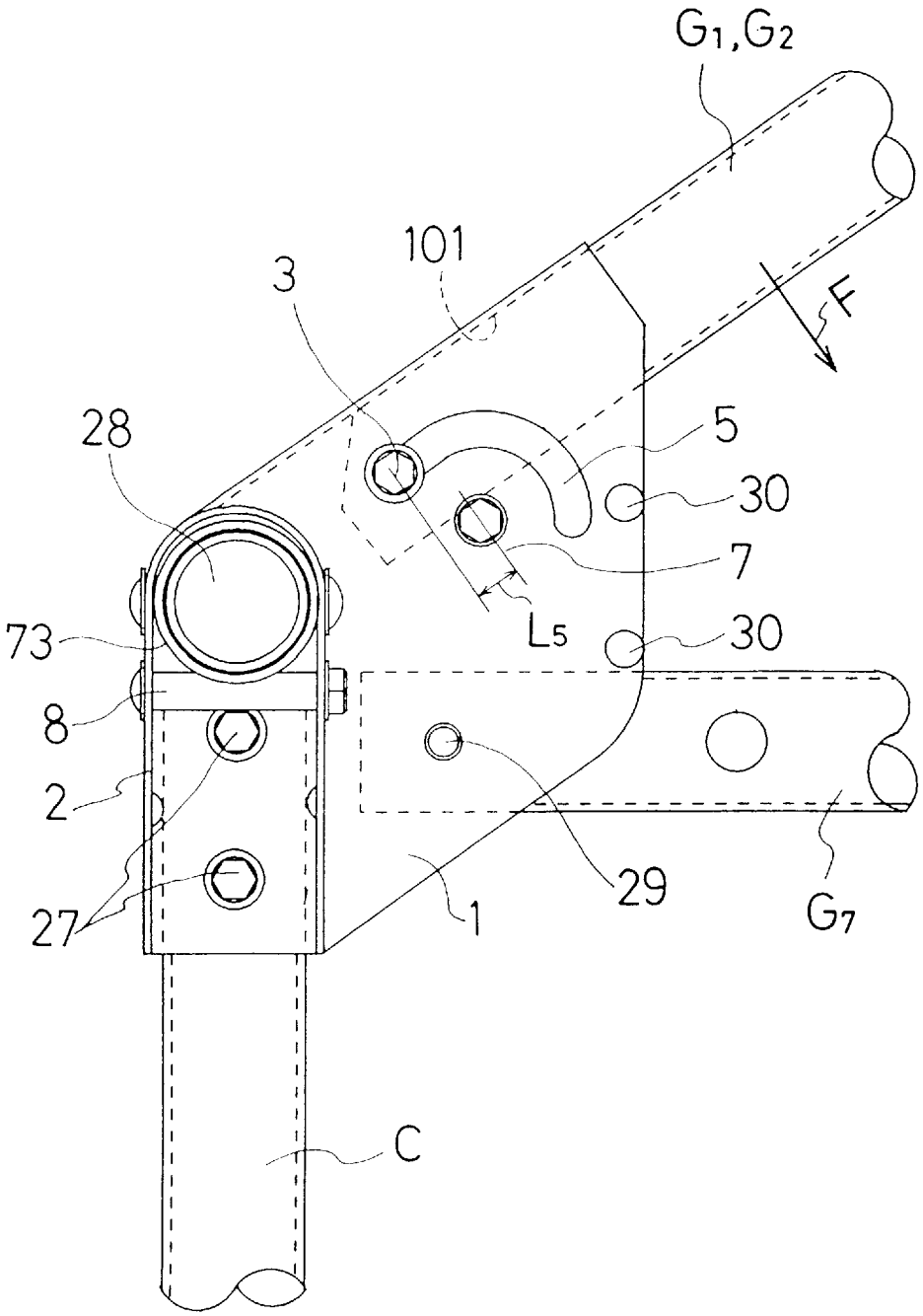
FIG. 15 is a front view of FIG. 13.

Analogously, long aperture 5 of reverse U-letter figured member 1 comprises a parallel portion 501 (FIG. 10) parallel to bottom portion 101 of reverse U-letter figured member 1, as shown in FIG. 15. Parallel portion 501 guides pin 3 along the inside of long aperture 5 in such a manner as the upper surfaces of joint beams G1 and G2 are in contact with bottom portion 101. Long aperture 5 further comprises bent portion 502. Bent portion 502 guides pin 3 in a manner such that the upper surfaces of joint beams G1 and G2 are separated from bottom portion 101 of reverse U-letter figured member 1 when joint beams G1 and G2 are bent downward, as shown in FIG. 15. Further, as shown in FIGS.

14 and 15, the tops of poles C are connected with two pins 27 to reverse U-letter figured member 2 so as to be positioned vertically relative to the crossbeams G3 and G4.

As shown in FIGS. 14 and 15, pins 3 and 4 are guided along parallel portions 501 and 601 of long apertures 5 and 6 when the surfaces of joint beams G1 and G2 and crossbeams G3 and G4 are in contact with the insides of bottom portions 101 and 201. Pins 7 and 8 penetrate reverse U-letter figured member 2 in a manner such that bottom portions 101 and 201 are in contact with the under surfaces of joint beams GI and G2 and crossbeams G3 and G4.

Referring now to FIG. 14, the location relationship between pin 4 and pin 8 is illustrated. Specifically, pins 4 and 8 are located relative to each other in a manner such that pin 8 is located to the inside of the framework relative to pin 4 by a distance L4. By virtue of this placement, pin 8 absorbs any force F that results between pin 8 and bottom portion 201 of reverse U-letter figured member 2. Further, when crossbeams G3 and G4 are bent downward to the position of G3' and G4' by the displacement of pin 4 along aperture 6, pin 4 guides the under surfaces of crossbeams G3 and G4. Thus, the placement and action of pin 4 renders crossbeams G3 and G4 easily bendable. Additionally, by virtue of the fact that pin 8 penetrates reverse U-letter figured member 2, the rigidity of reverse U-letter figured member 2 is increased. That is, as shown in FIG. 13, when a force F acts to broaden the distance of reverse U-letter figured member 2, pin 8 absorbs the force.

Figure 9:
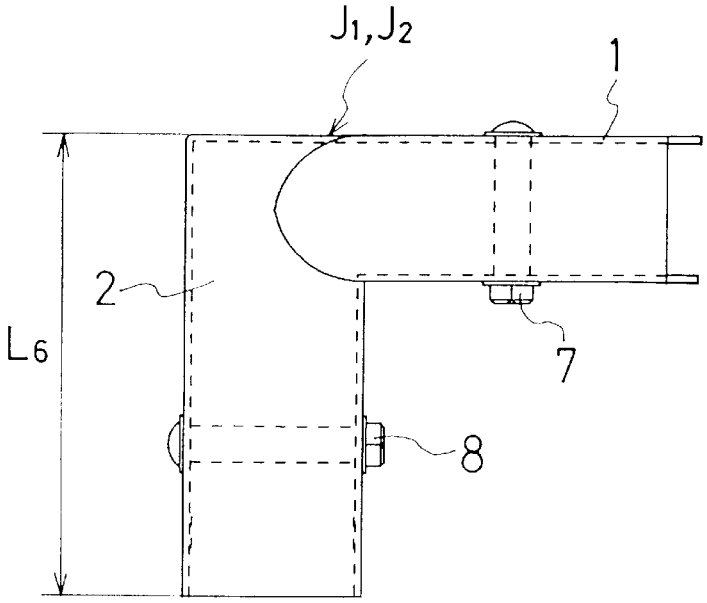
FIG. 9 is a plan view of joints J1 and J2 in FIG. 1.

In addition, as is shown in FIGS. 9 and 10, when a building is constructed in which the length $L_6$ of reverse U-letter figured member 2 and the length of $L_7$ of reverse U-letter figured member 1 are increased, the contact area between joint beams G1 and G2 and bottom portion 101 of reverse U-letter figured member 1 is increased. Additionally, the contact area between crossbeams G3 and G4 and the bottom portion 201 of reverse U-letter figured member 2 is increased. In this manner, reverse U-letter figured members 1 and 2 provide strength and rigidity against such forces and/or three dimensional torsion. In the case of small structures, e.g. dog houses, or in other instances where increased strength or rigidity is not required, pins 7 and 8 can be omitted to simplify the framework. In such cases, any forces F acting on joint beams G1 and G2 and crossbeams G3 and G4 can be absorbed by pins 3 and 4 and bottom portions 101 and 201 of reverse U-letter figured members 1 and 2, respectively.

Referring now to FIG. 15, the location relationship between pin 3 and pin 7 is illustrated. Specifically, pins 3 and 7 are located relative to each other in a manner such that pin 7 is located to the inside of the framework relative to pin 3 by a distance $L_5$. By virtue of this placement, pin 7 absorbs any force F acting downward on joint beams G1 and G2. Further, when joint beams G1 and G2 are bent downward, pin 7 maintains contact with the under side of joint beams G1 and G2, thereby guiding the motion of joint beams G1 and G2 during bending. In addition, by virtue of the fact that pin 7 penetrates reverse U-letter figured member 1, the rigidity of reverse U-letter figured member 1 is enhanced. That is, as is shown in FIG. 13, when a horizontal force F (or any three dimensional torsion force likely to broaden reverse U-letter figured member 1) acts on joint beams G1 and G2, such a force is absorbed by pin 7.

Further, long apertures 5 and 6 are positioned relative to pins 7 and 8 in a manner such that pins 3 and 4 are guided from horizontal portions 501 and 601 to bent portions 502 and 602 of long apertures 5 and 6. When joint beams G1 and G2 and crossbeams G3 and G4 are displaced, the under sides of joint beams Gl and G2 and crossbeams G3 and G4 are guided by pins 7 and 8 such that the folding and construction of the framework may be carried out easily.

Joints J1 and J2, shown in FIG. 13, are of the type that reverse U-letter figured member 2 is not penetrated by crossbeams G3 and G4. However, joints J1 and J2, as illustrated in FIGS. 12, 14 and 15, have provided thereon through-hole 28 in reverse U-letter figured member 2, such that crossbeams G3 and G4 penetrate reverse U-letter figured member 2. In this embodiment of the invention, a ring 73 is provided around crossbeams G3 and G4. On both sides of ring 73, pins 4 are planted. Further, the tip ends of crossbeams G3 and G4 have provided thereon stoppers 74 to prevent crossbeams G3 and G4 from being pulled out of ring 73. By virtue of this structure, no matter what the position of crossbeams G3 and G4 on joints J1 and J2, pins 4 and 8 maintain their position relative to long aperture 6 as described hereinabove. Furthermore, as shown in FIG. 14 as G3' and G4', when crossbeams G3 and G4 are bent downward, ring 73' abuts to stopper 74' to prevent crossbeams G3 and G4 from being pulled out of ring 73. Further, as is shown in FIG. 15, a mounting hole 29 for mounting a connection beam G7 to reinforce the rigidity of the framework is provided on reverse U-letter figured member 1.

In addition, reverse U-letter figured members 1 and 2 have provided thereon embossments 30 projecting inside them. Joint beams G1 and G2 and crossbeams G3 and G4, when bent, abut to embossments 30 to maintain the folded state. Further, as shown in FIG. 10, the height (H1, H2) of reverse U-letter figured members 1 and 2 is increased to provide embossments 30 at two positions. Reference numeral 31 shows a pole mounting hole.

Figure 18:
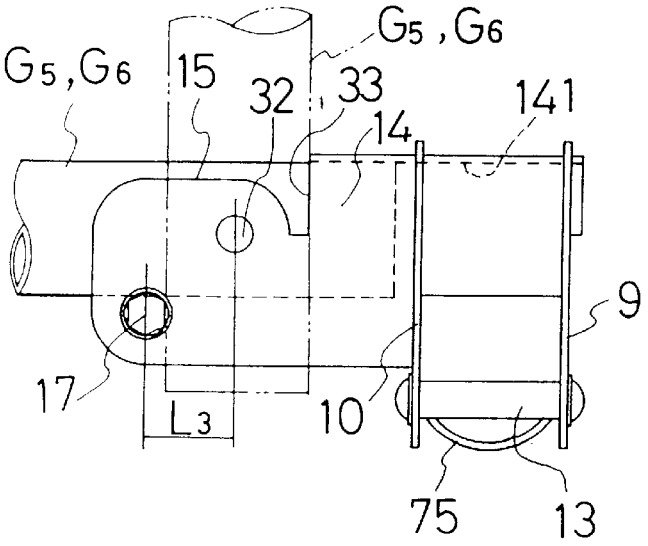
FIG. 18 is a right side view of FIG. 17.
Figure 19:
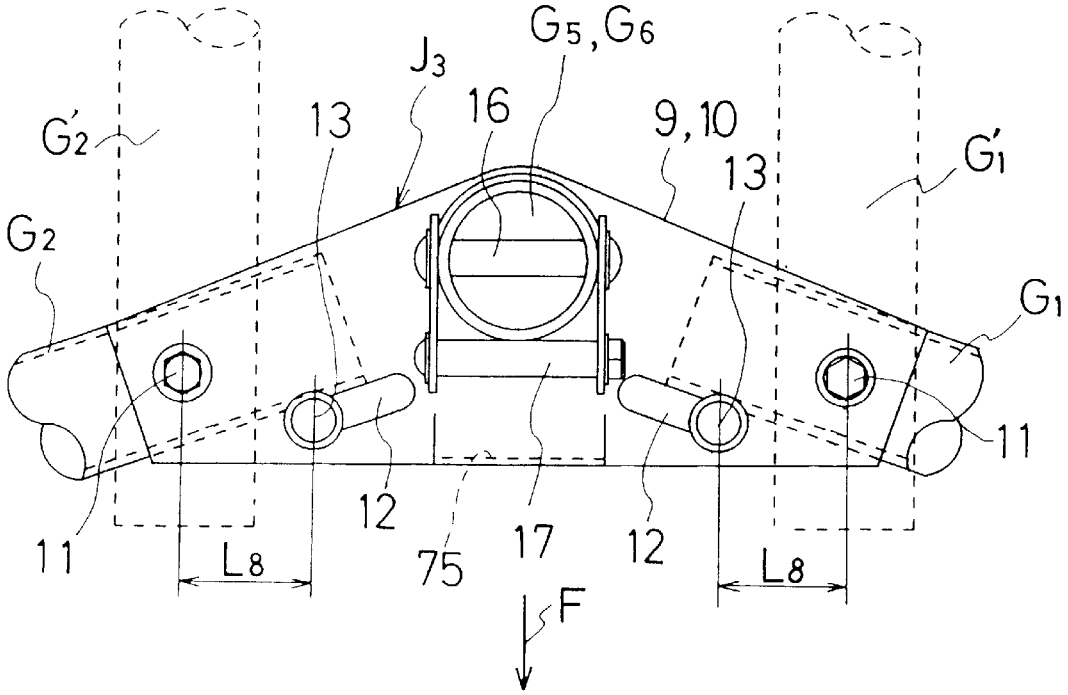
FIG. 19 is a front view showing the state in which ajoint beam and a crossbeam are coupled with the joint J3 of FIG. 17.

Joint J3, as shown in FIGS. 16–19, is formed with two plates 9 and 10 made in one unit at a bottom portion 75 having a U-letter configuration. Plates 9 and 10 operate to clamp the ends ofjoint beams GI and G2, which are connected with pin 11 (FIG. 19). Pin 13 is provided, which is guided and displaced along long apertures 12 provided on two plates 9 and 10. Preferably pin 13 is placed such that when joint beams G1 and G2 pivot around pin I 1, the ends of joint beams G1 and G2 change to abut or not to abut pin 13.

In the construction of the framework shown in FIG. 19, joint beams G1 and G2 are supported by pins 13 and generally are not capable of being bent in the direction of arrow (a) as shown in FIG. 1. From this position, if pins 13 are dislocated along aperture 12, the ends of joint beams G1 and G2 will no longer be engaged with pins 13, and thus the framework will be capable of being folded in the direction of arrow (a) as shown in FIG. 1. Additionally, as joint beams G1 and G2 are clamped by plates 9 and 10, joint beams G I and G2 may be folded at right angles to each other, as shown as G1' and G2'.

Further, the inclination of long apertures 12 is set in such a manner that pins 13 fall freely by weight from the upper to the lowest position (i.e., the position shown in FIG. 19) when constructing the framework to make the process of assembling the framework easier. Of course, in the state where joint beams G1 and G2 are bent in the direction of arrow (a) of FIG. 1, the long aperture 12 is upside down, so that pins 13 fall freely by weight to the upper position, where pins 13 do not abut to joint beams G1 and G2. When the framework is constructed, as by raising joint beams G1 and G2, pins 13 will fall freely into the lowest position, i.e., the position shown in FIG. 19.

Figure 16:
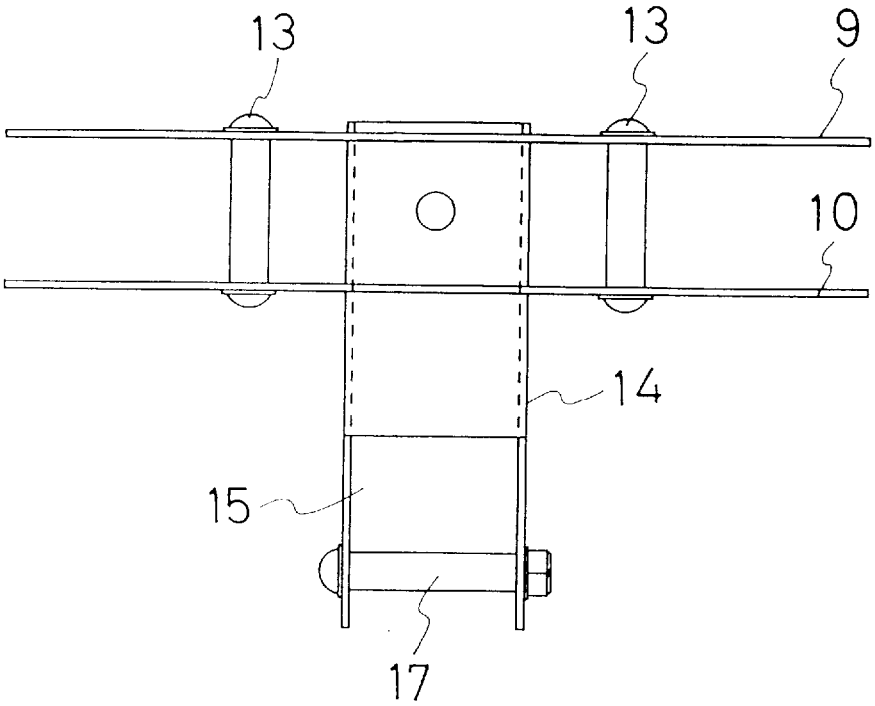
FIG. 16 is a plan view of the joint J3 in FIG. 1.
Figure 17:
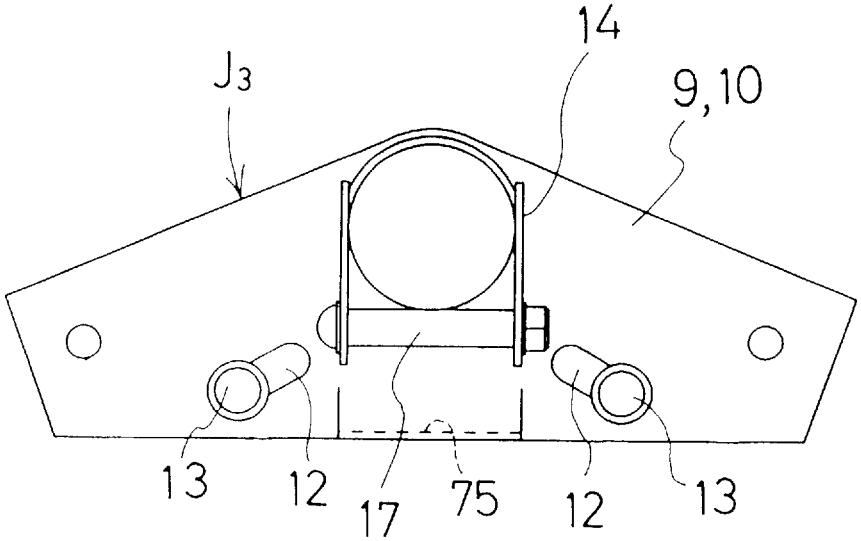
FIG. 17 is a front view of FIG. 16.

As to the relative position of pins 11 and 13, pins 13 are positioned toward the center of joint J3 relative to pins 11 by a distance $L_8$. By virtue of this placement, any force F acting on the center of joint J3 is absorbed by pins 11 and 13. As is shown in FIGS. 16 and 18, a reverse U-letter figured member 14, is attached vertically on the side of one of two plates 9 and 10. At a bottom end of reverse U-letter figured member 14, there is provided a cut out portion 15. As shown in FIG. 19, the ends of ridge beams G5 and G6 are coupled and connected within cut-out portion 15 with a pin 16.

As is also shown in FIGS. 18 and 19, pin 17 is provided and positioned such that, when ridge beams G5 and G6 are horizontal, pin 17 maintains contact with the under side of ridge beams G5 and G6 and penetrates cut out portion 15 of reverse U-letter figured member 14. The position of pin 17, as shown in FIG. 18, is located toward the inside of the framework by a distance $L_3$ relative to hole 32 for pin 16. Therefore, when a downward force is applied to joint J5 of FIG. 1, the generated forces are absorbed by pins 16 and 17. Alternatively, by contacting the ends of ridge beams G5 and G6 to a bottom portion 141 of reverse U-letter figured member 14, as shown in FIG. 18, any generated forces may be absorbed by pin 17 and bottom portion 141 of reverse U-letter figured member 14. Further, as shown in FIG. 18, even when ridge beams G5 and G6 turn at right angles around pin 16 to the positions G5' and G6', respectively, while ridge beams G5 and G6 are in contact with the pin 17, pin 17 abuts to stopper face 33 of reverse U-letter figured member 14. Thus, ridge beams G5 and G6 are limited to turning in a direction that results in the framework being folded.

As shown in FIGS. 16 and 18, reverse U-letter figured member 14 penetrates two plates 9 and 10. The rigidity of plates 9 and 10 is further increased by unifying plates 9 and 10 with a bottom portion 75. Additionally, ridge beams G5 and G6 can be constructed so as to penetrate plates 9 and 10. In the case that ridge beams G5 and G6 penetrate plates 9 and 10, a stopper 74, as shown in FIG. 14, is mounted on the end of ridge beams G5 and G6.

Joint J5 will now be described with reference to FIG. 23. Joint J5 connects two-divided ridge beams G5 and G6. Specifically, the divided ends of ridge beams G5 and G6 couple with reverse U-letter figured member 18 and are connected by a pin 19 which penetrates both sides of reverse U-letter figured member 18. Reverse U-letter figured member 18 comprises long aperture 20 which in turn comprises a parallel portion 201 and a bent portion 202. Parallel portion 201 in parallel to bottom portion 181 of reverse U-letter figured member 18. Parallel portion 201 guides pin 19 in a manner such that the upper surface of ridge beams G5 and G6 are in contact with the inner side thereof in the horizontal state of ridge beams G5 and G6. Bent portion 202 guides pin 19 in a manner such that the ends of ridge beams G5 and G6 separate from bottom portion 181 of ridge beams G5 and G6 when the ends of ridge beams G5 and G6 are bent upward. In the embodiment illustrated in FIG. 23, parallel portion 201 of long aperture 20 is located at the end portion of bent portion 202 of long aperture 20 where pin 19 stops. The reverse U-letter figured member 18, as shown in FIG. 24, is configured in accordance with ridge beams G5 and G6 and is made of a pipe member.

Figure 22:
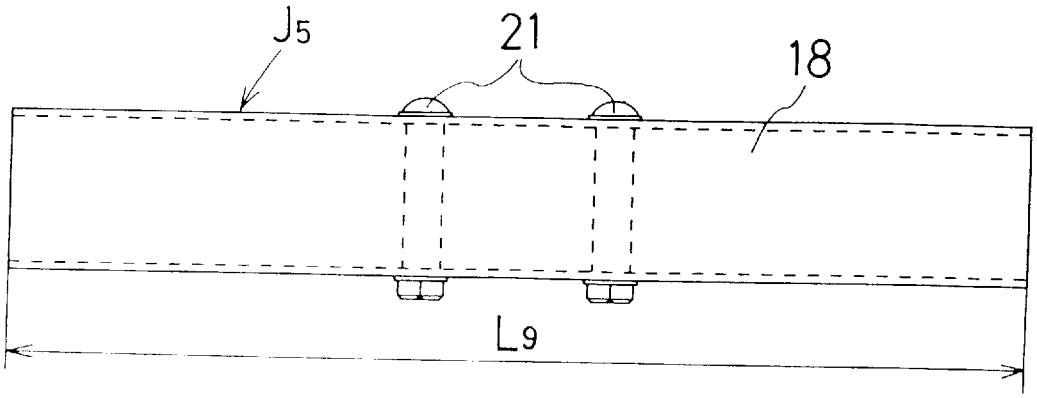
FIG. 22 is a plan view of the joint J5 in FIG. 1.

When pin 19 is guided to parallel portion 201 of long aperture 20 and the upper sides of ridge beams G5 and G6 are in contact with bottom portion 181 of reverse U-letter figured member 18, there is provided a pin 21 which is in contact with the under sides of ridge beams G5 and G6 by penetrating reverse U-letter figured member 18. Any forces generated by a downward force F applied to the joint J5 is absorbed by pin 21 and bottom portion 181 of reverse U-letter figured member 18. Further, as shown in FIG. 22, length $L_9$ of reverse U-letter figured member 18 is prolonged, length $L_{10}$ shown in FIG. 24 is prolonged, and thus, any forces generated between pin 21 and ridge beams G5 and G6 are reduced and transferred to the length of the framework, as shown in folded form in FIGS. 6 and 7. Further, since pin 21 penetrates reverse U-letter figured member 18, pin 21 absorbs the forces, thereby broadening reverse U-letter figured member 18 when a horizontal or three dimensional force acts on the ridge beams G5 and G6. In this manner, the rigidity of reverse U-letter figured member 18 is increased. Furthermore when ridge beams G5 and G6 are bent upward while displacing pin 19 along aperture 20, pin 21 maintains contact with the under sides of ridge beams G5 and G6. Pin 21 thus guides ridge beams G5 and G6, making the bending thereof easier.

Figure 2:
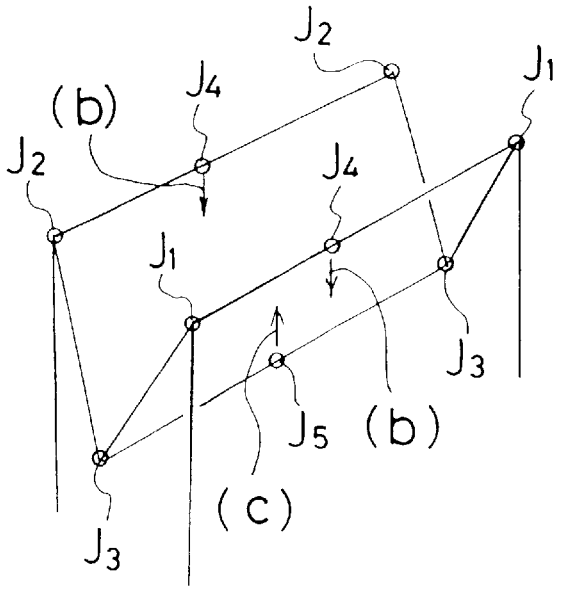
FIG. 2 is a perspective view of a framework for a building folded according to FIG. 1.
Figure 20:
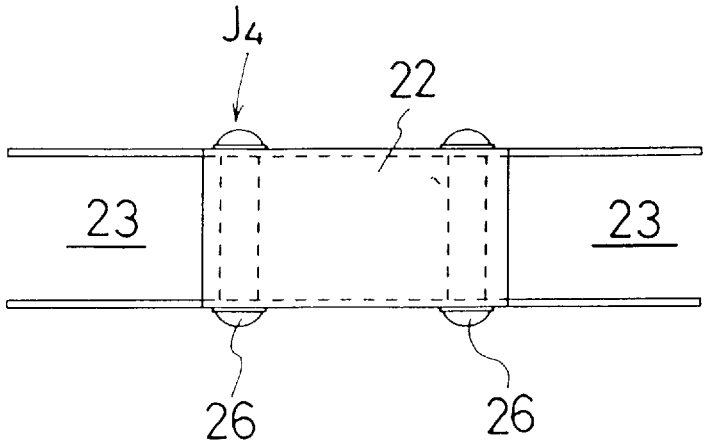
FIG. 20 is a plan view of the joint J4 in FIG. 1.
Figure 21:
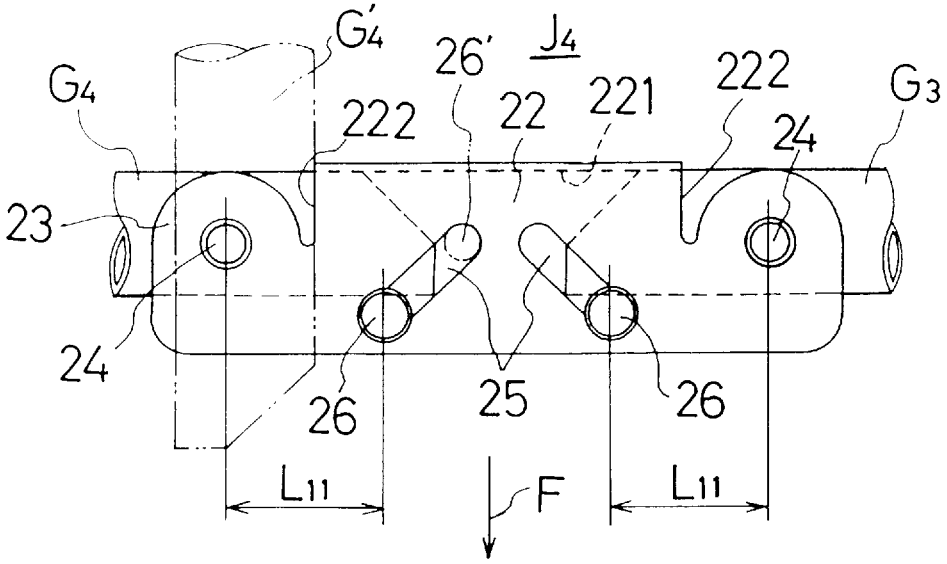
FIG. 21 is a front view of FIG. 20.

Joint J4 connects the ends of two divided crossbeams G3 and G4 as shown in FIG. 1 and can be folded in the direction of arrow (b) as shown in FIG. 2. Referring to FIGS. 20 and 21, crossbeams G3 and G4 are coupled with reverse U-letter figured member 22 at the bottom portion 221 of reverse U-letter figured member 22. Preferably, reverse U-letter figured member has a bottom portion thereof cut out to form cut out portion 23. Each end of crossbeams G3 and G4 is connected by a pin 24. Additionally, pin 26 is provided which moves along long apertures 25 provided on the sides of reverse U-letter figured member 22. When pin 26 so moves, and when crossbeams G3 and G4 pivot around pin 24 as illustrated by G4', the ends of crossbeams G3 and G4 move so as to abut or not to abut pin 26.

FIG. 21 shows the state where pin 26 is in contact with the ends of crossbeams G3 and G4. Position 26' shows the state where pin 26 is not in contact with the ends of crossbeams G3 and G4. Long aperture 25 is designed so that pin 26 slides naturally from a position of 26' into the position of 26, rendering assembly of the framework easy. When crossbeams G4 is turned to the position G4' around pin 24 at right angles, stopper surface 22 prohibits crossbeam G4 from being turned further.

In the state where pin 26 is in contact with the ends of crossbeams G3 and G4 (FIG. 21), pin 26 is dislocated toward the center of the framework by the distance $L_{11}$ from pin 24. Pins 24 and 26 are designed to absorb the forces generated when downward force F is applied to joint J4. The distance $L_{11}$ is set to be that distance at which the forces generated by downward force F are minimized, thus contributing to the overall rigidity of pins 24 and 26.

Figure 25:
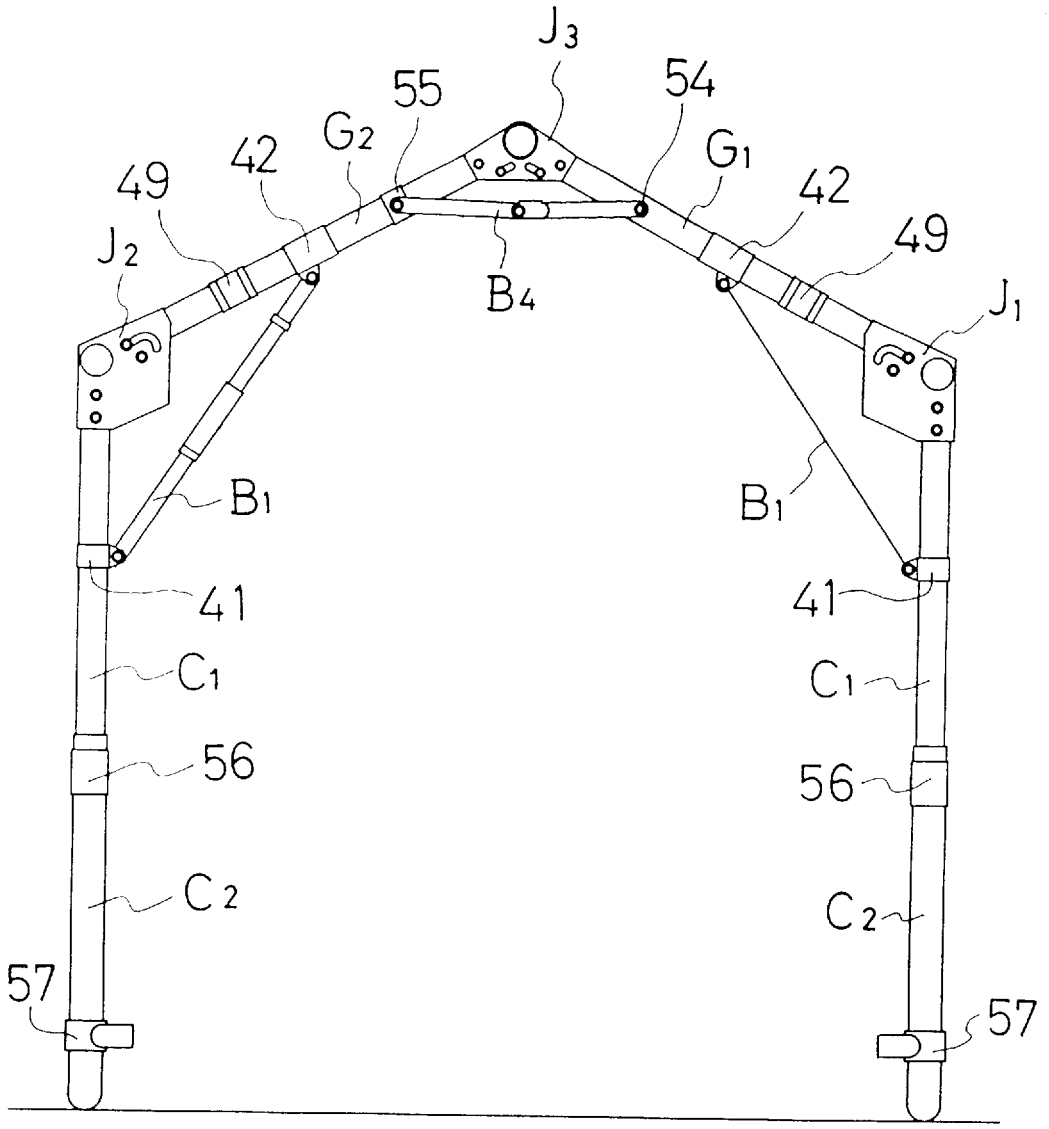
FIG. 25 is a front view of a framework for a building.
Figure 26:
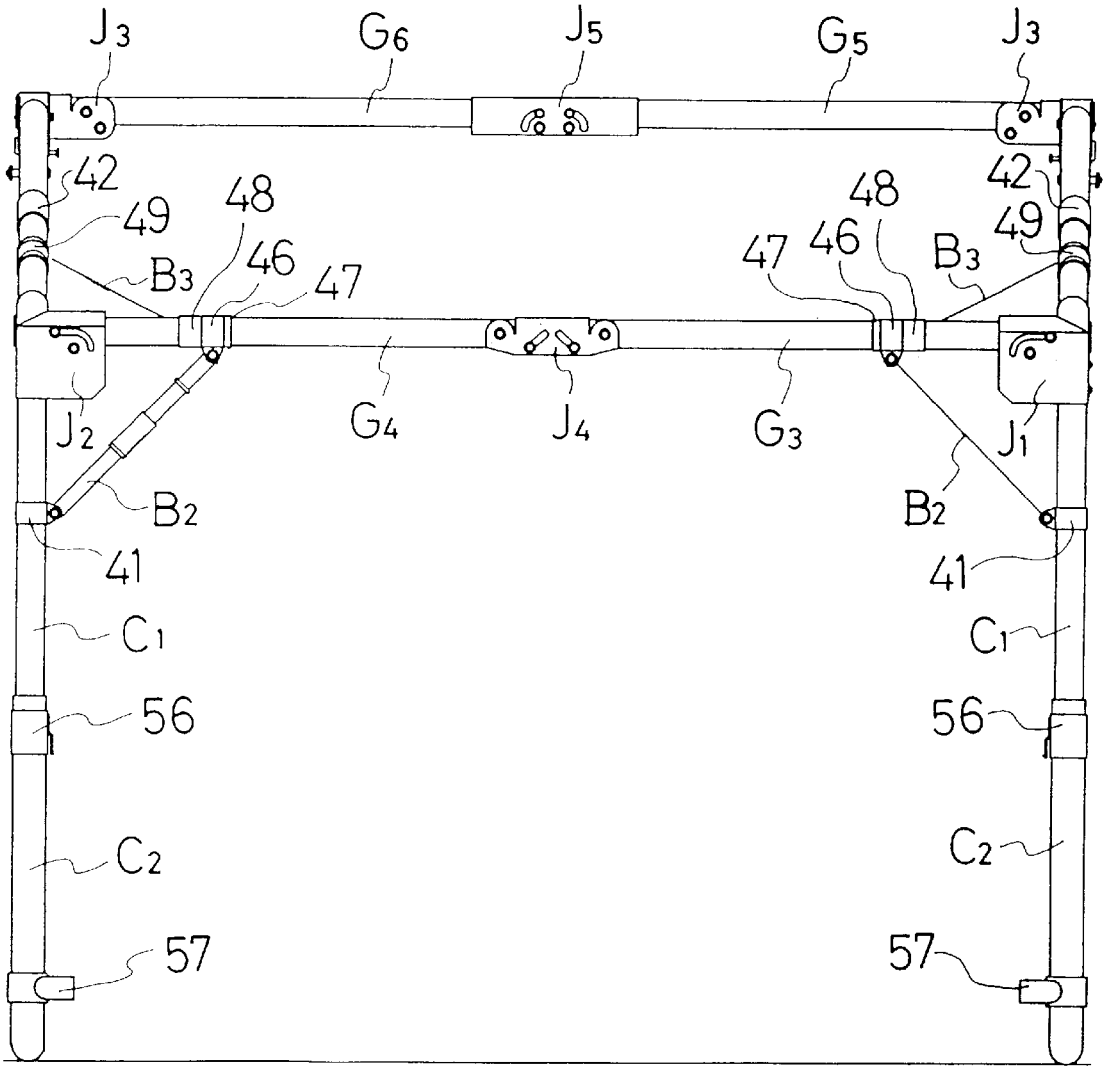
FIG. 26 is a side view of FIG. 25.
Figure 27:
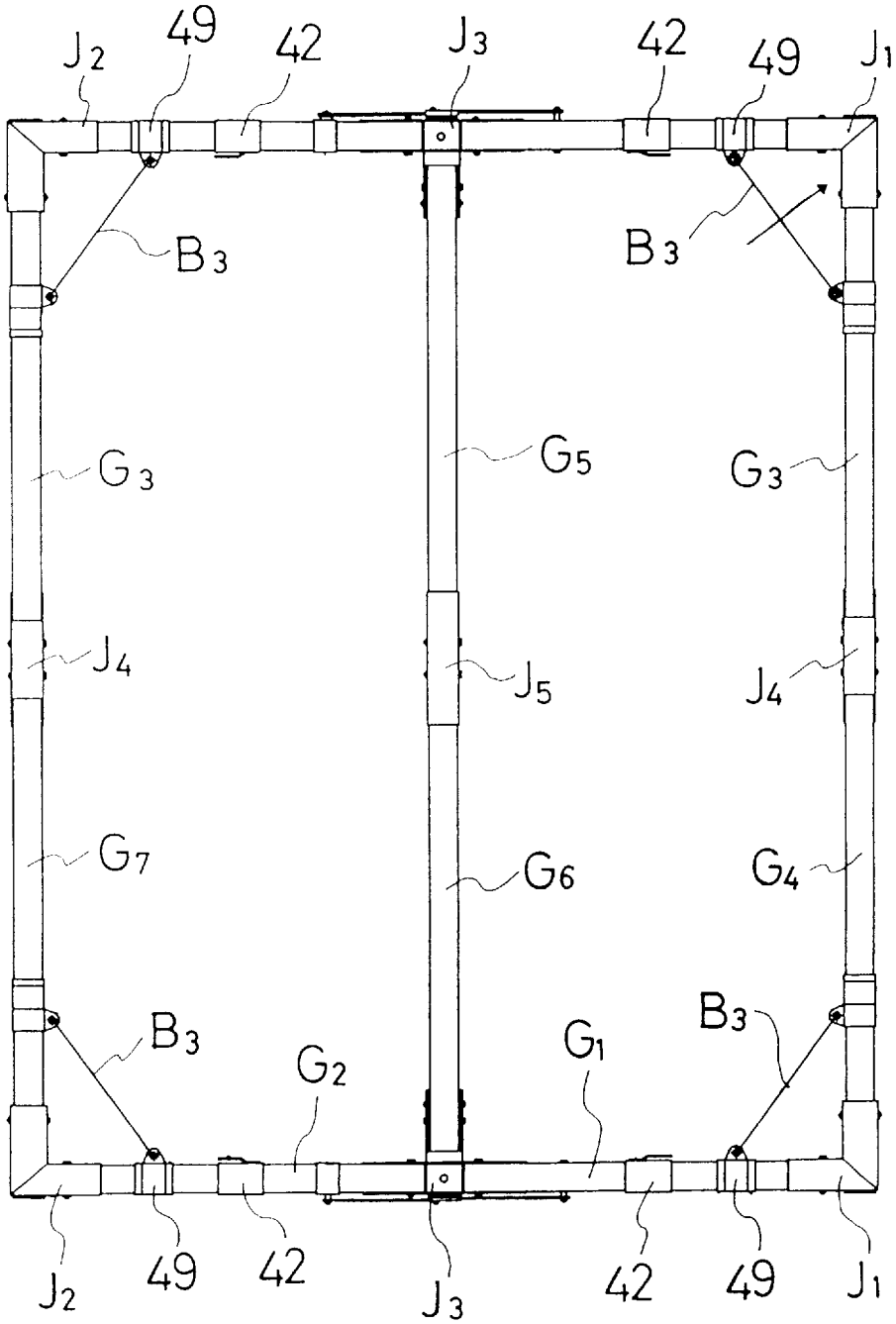
FIG. 27 is a plan view of FIG. 25.

FIGS. 25–27 show the state where the framework is assembled as a framework for a building. In the case where the framework or portions thereof are to be used as shelters for use in outdoor sports, expositions or fairs, or are to be used as a small dog houses or as a roof member or wall member, the framework is rigid enough without the addition of further components. However, if the framework as assembled is to be a larger structure, a stronger, more rigid structure may be desirable.

As shown in FIG. 25, brace B1 may be provided between joint beams G1 and G2 and poles C to provide the desired rigidity. Additionally, brace B4 may be provided between the joint beam G1 and G2 to provide additional rigidity. Further, in FIGS. 26 and 27, brace B2 is provided between crossbeams G3 and G4 and poles C, while brace B3 is provided between crossbeams G3 and G4 and joint beams G1 and G2. Additionally, pole C is divided into two parts C1 and C2, and pole C1 is inserted into pole C2 so that the height of the building may be adjusted and so that the folded framework may be more compact.

Figure 39:
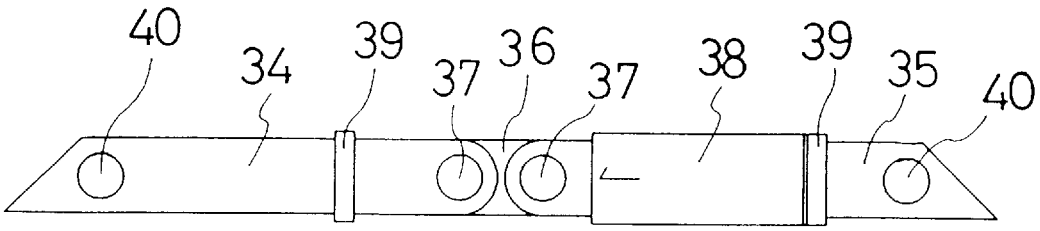
FIG. 39 is a front view of a brace of FIG. 25.
Figure 40:
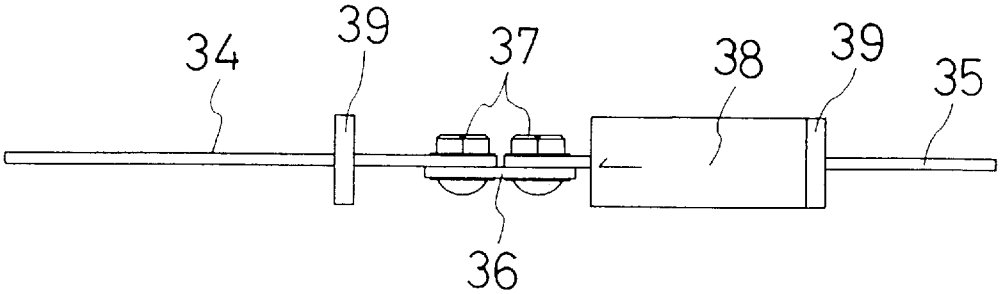
FIG. 40 is a plan view of FIG. 39.

Braces B1, B2 and B3 as shown in FIGS. 39 and 40, comprise two plates 34 and 35 connected with connecting member 36 by pins 37. Stopper 38 is provided to prevent the plates 34 and 35 from being bent. As is shown in FIGS. 39 and 40, plates 34 and 35 are able to be folded by sliding stopper 38 to the position of another stopper 39 while separating from connecting member 36. When the position of stopper 38 is reversed, stopper 38 prevents plates 34 and 35 from being bent. Reference numeral 40 is a hole for a bolt. In addition, in FIGS. 25, 26 and 27, although braces B1, B2 and B3 are shown as being linear, this illustration is for simplification only and the shape of braces B1, B2 and B3 may be identical to that shown in FIGS. 39 and 40.

Figure 48:
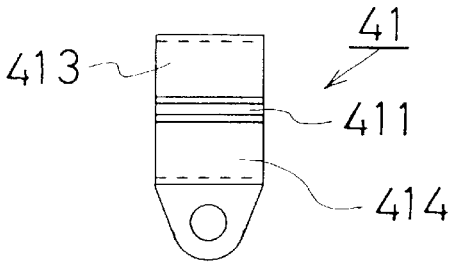
FIG. 48 is a front view of the mounting metals in FIG. 25.
Figure 49:
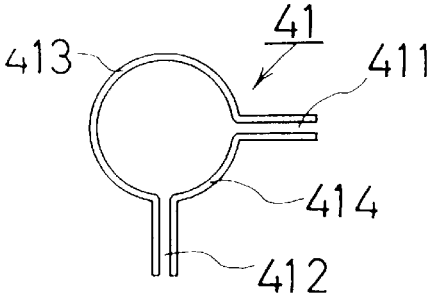
FIG. 49 is a side view of FIG. 48.

In FIGS. 25 and 26, a mounting metal 41 for mounting the ends of braces BI and B2 on pole C1 is illustrated. As shown in FIGS. 48 and 49, mounting metal 41 may be divided into two members 413 and 414. Specifically, mounting metal 41 can connect two ends of braces Bl and B2 by connecting the end of brace BI with terminal end 411, connecting the end ofthe brace B2 with terminal end 412. In this manner, mounting metal 41 may be fixed on pole C1.

Figure 35:
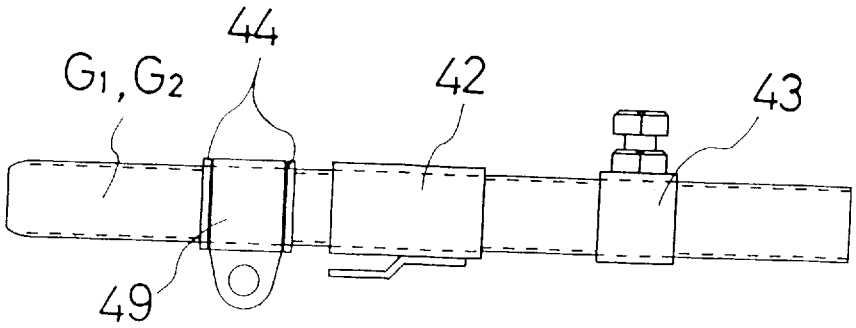
FIG. 35 is a front view of a joint beam in FIG. 25.
Figure 36:
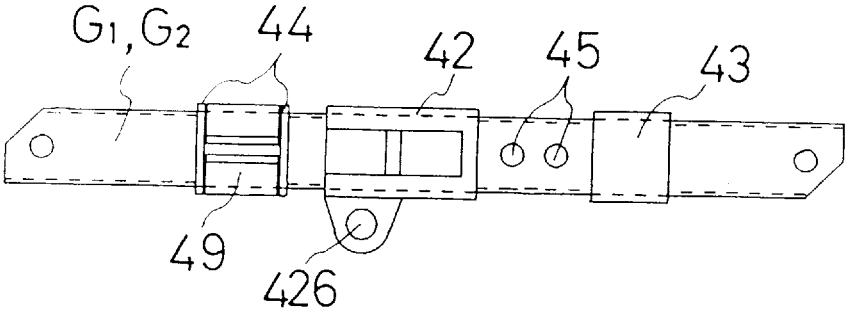
FIG. 36 is a plan view of FIG. 35.
Figure 43:
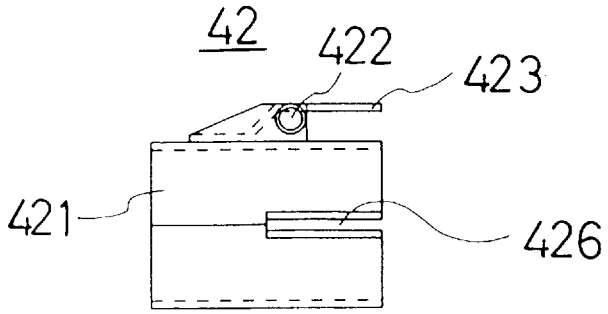
FIG. 43 is a front view of the mounting metals in FIG. 25.
Figure 44:
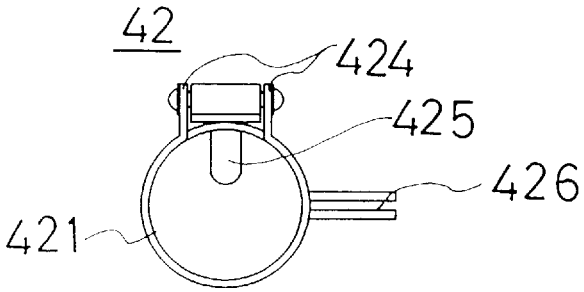
FIG. 44 is a side view of FIG. 43.

Mounting metal 42, as shown in FIGS. 43 and 44, may be provided with a cut and raised portion 424. Cut and raised portion 424 may be formed, for example, by cutting a part of the circumference of a ring pipe 421 and raising it. A lever 423 is provided with a spring supported by pin 422. Furthermore, lock pin 425 is provided on the raised portion 424 of ring pipe 421 by operating lever 423. Further, connection part 426 is provided which connects the end of brace B1 on the outer circumference of ring pipe 421. In FIGS. 35 and 36, joint beams G1 and G2 are attached with mounting metal 42. Mounting metal 42 is capable of being displaced between stopper 43 and stopper 44. Further, joint beams G1 and G2 have provided thereon lock holes 45, through which lock pin 425 (shown in FIG. 44) is coupled, thus locking the displacement of mounting metal 42.

Thus, one end of brace B1 is connected with mounting metal 41 fixed on pole C1. The other end of brace B1 is connected with mounting metal 42 which is able to be displaced against joint beams G1 and G2 and locked in this position. In this manner, brace Bl may be bent, i.e., when mounting metal 42 is displaced during the folding of the framework. When the framework is assembled, brace B1 provides additional desired rigidity, i.e., when mounting metal 42 is locked.

Figure 37:
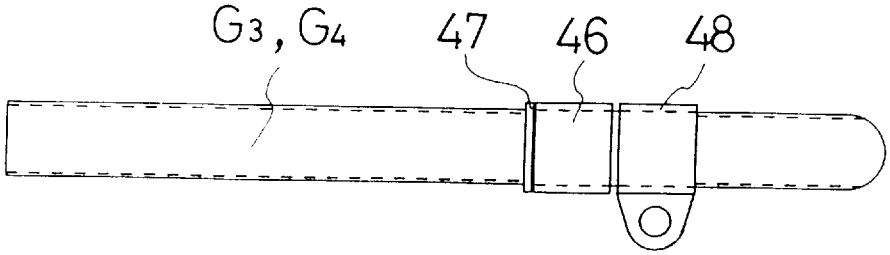
FIG. 37 is a front view of a crossbeam of FIG. 26.
Figure 38:
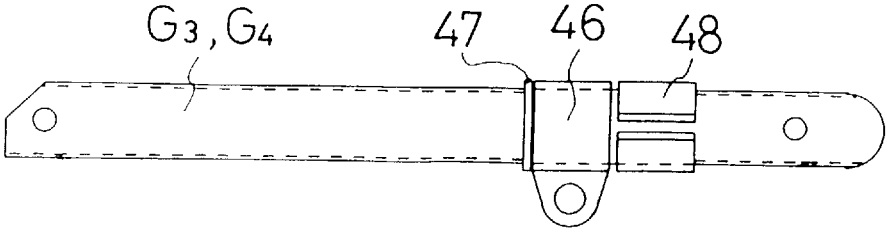
FIG. 38 is a plan view of FIG. 37.
Figure 45:
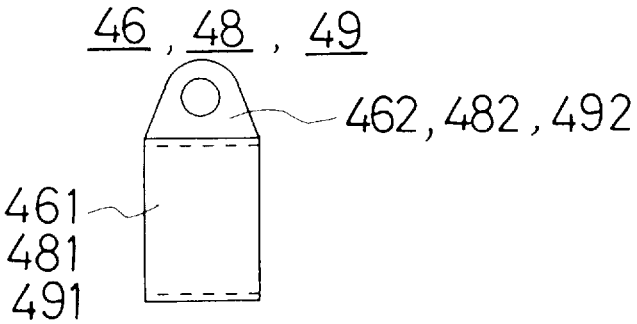
FIG. 45 is a front view of the mounting metals in FIG. 26.
Figure 46:
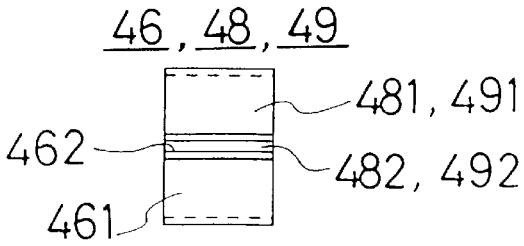
FIG. 46 is a plan view of FIG. 45.
Figure 47:
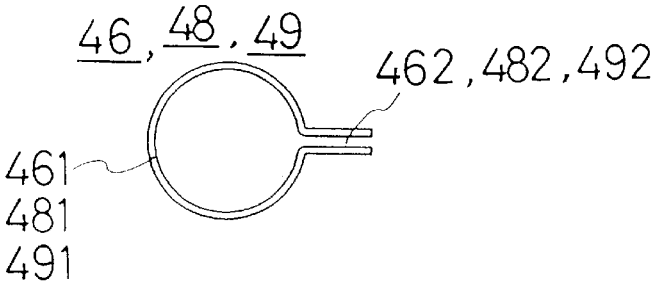
FIG. 47 is a side view of FIG. 45.

As shown in FIGS. 45–47, mounting metal 46 is provided to connect the other end of brace B2 with crossbeams G3 and G4. Mounting metal 46 is made from C-ring 461, the end of which is bent to form connection part 462. In FIGS. 37 and 38, the attachment of crossbeams G3 and G4 with mounting metal 46 is illustrated. As shown in FIG. 26, stopper 47 may be provided so that mounting metal 46 may be displaced toward the side of joints J1 and J2 and not toward the side of joint J4.

Thus, one end of brace B2 is connected with mounting metal 41 fixed on pole C1. The opposite end of brace B2 is connected with mounting metal 46. In this manner, when the framework is folded, and mounting metal 46 is displaced toward the side of the joint J1 and J2 and brace B2 is bent. When the framework is assembled, brace B2 cannot be bent, and thus functions as a brace.

Mounting metal 48 connects one end of brace B3 and crossbeams G3 and G4. Mounting metal 49 connects the other end of brace B3 and joint beams G1 and G2. Mounting metals 45, 48 and 49, as shown in FIGS. 45–47, are made of C-rings 481 and 491 and form connecting portions 482 and 492. FIGS. 37 and 38 show crossbeams G3 and G4 attached with the mounting metal 48. As shown in FIG. 26, mounting metal 48 may be displaced toward the side of joints J1 and J2, but not toward the side of joint J4 by virtue of the placement of stopper 47.

As shown in FIGS. 26, 27, 35 and 36, mounting metal 49 connects the opposite end of brace B3 and joint beams G1 and G2. Mounting metal 49 is prevented from being displaced against joint beams G1 and G2 by stopper 44. Thus, since one end of brace B3 is connected with mounting metal 49 and the opposite end of brace 83 is connected with mounting metal 48, brace B3 may be bent when folding the framework. Specifically, brace B3 may be bent by displacing mounting metal 48 toward joints J1 and J2. Alternatively, when assembling the framework, since mounting metal 48 may not be displaced toward joint J4 due to stopper 47, brace B3 cannot be bent and thus, brace B3 functions as a brace.

Figure 41:
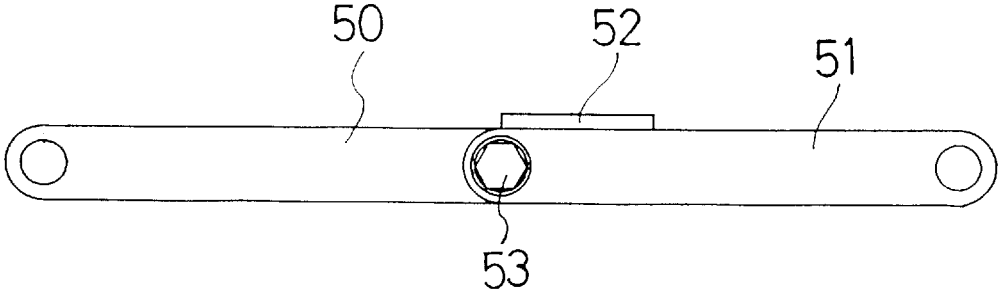
FIG. 41 is a front view of a brace of FIG. 25.
Figure 42:
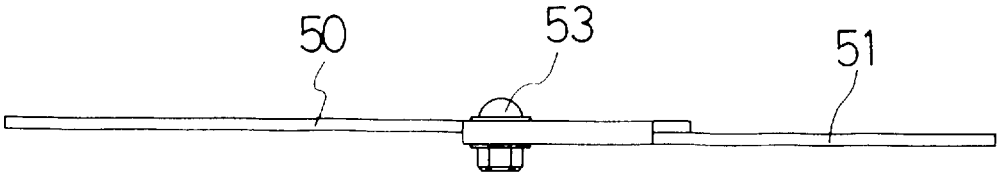
FIG. 42 is a plan view of FIG. 41.
Figure 50:
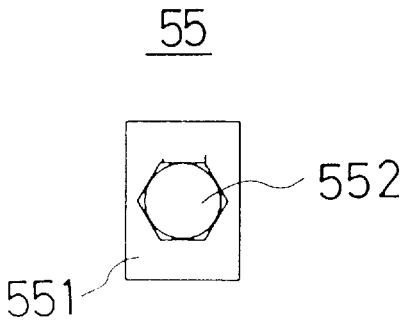
FIG. 50 is a plan view of the mounting metals in FIG. 25.
Figure 51:
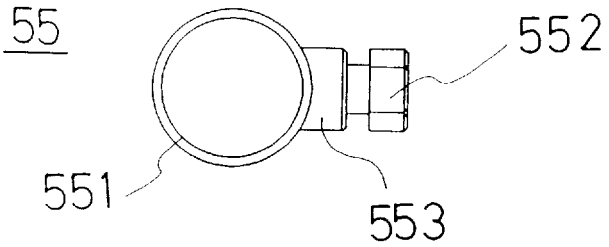
FIG. 51 is a side view of FIG. 50.

As shown in FIGS. 41 and 42, brace B4 is formed with plates 50 and 51 connected by pin 53. Stopper 52 is formed in a unit with plate 51 in order to prevent plate 51 from being bent upward by pin 53. As shown in FIG. 25, one end of brace B4 is connected with joint beam G1 with pin 54, and the opposite end thereof is connected with joint beam G2 with mounting metal 55. This mounting metal 55, as shown in FIG. 50 and 51, is formed by providing ring 551 with boss 553 in a unit, with which a bolt 552 is engaged. In this manner, mounting metal 55 is connected to brace B2. When folding the framework, brace B4 may be bent downward by loosening bolt 552 and displacing mounting metal 55.

Figure 28:
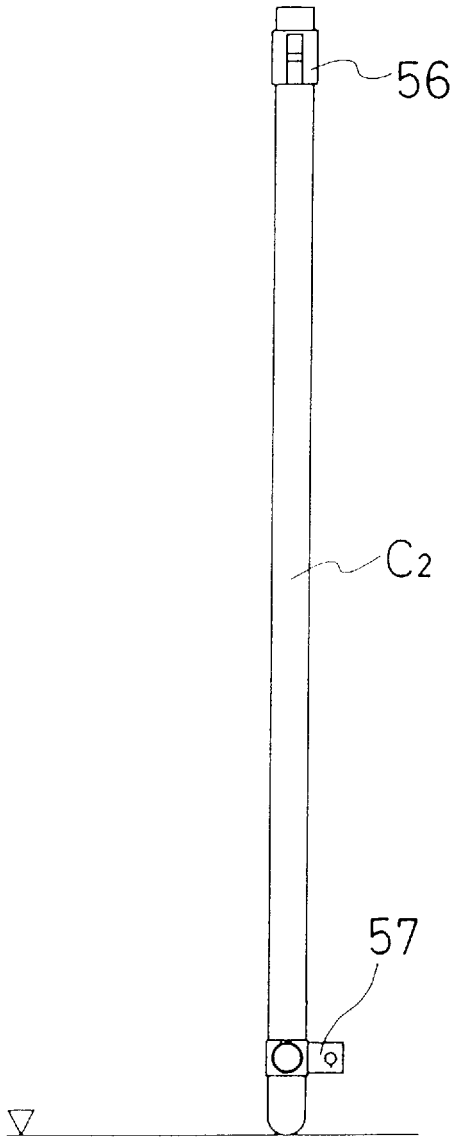
FIG. 28 is a front view of the pole in FIG. 25.
Figure 29:
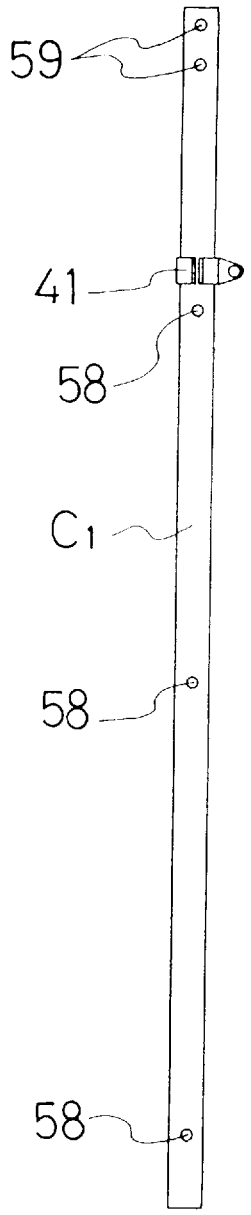
FIG. 29 is a front view of the pole in FIG. 25.

Referring now to FIG. 25, poles C1 and C2 are illustrated. Pole C2 comprises, as shown in FIG. 28, height regulator 56 fixed at its top, and mounting metal 57 on the lower end thereof Pole C1 comprises holes 58 and mounting metal 41 for adjusting the height of pole C, as shown in FIG. 29. At the tops of poles C, there are provided holes 59 for mounting joints J1 and J2. Pole C1 is adapted to be inserted into pole C2 to regulate the total height of pole C with height regulator 56.

Figure 30:
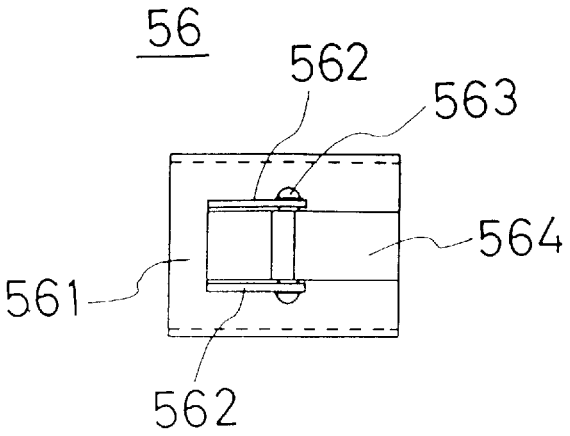
FIG. 30 is a plan view of the mounting metals in FIG. 25.
Figure 31:
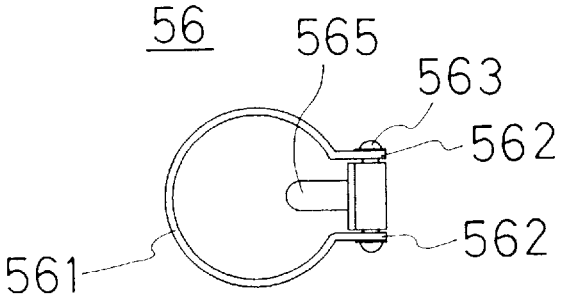
FIG. 31 is a side view of FIG. 30.
Figure 32:
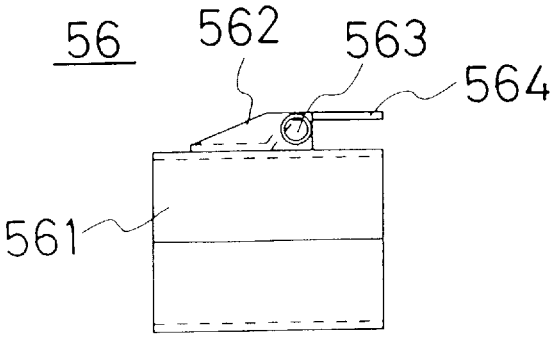
FIG. 32 is a front view of FIG. 30.

As shown in FIGS. 30–32, height regulator 56 supports lever 564 with a pin 563, and with a spring on the cut and raised portion 562 at the circumference of ring pipe 561. Lock pin 565 projects inside ring pipe 561 by operating lever 564. In the case of adjusting the height of pole C, by pushing lever 564, lock pin 565 is retreated. Then, by releasing lever 564 at the desired height of pole C, lock pin 565 projects so as to be inserted into lock hole 58 provided on pole C 1.

Figure 33:
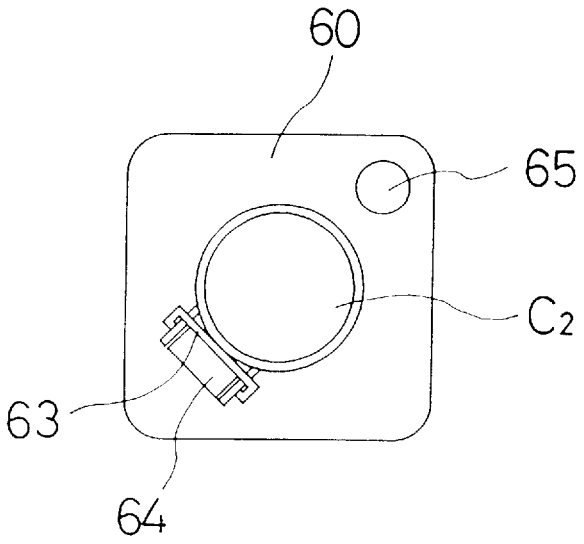
FIG. 33 is a plan view of a base plate of the pole in FIG. 25.
Figure 34:
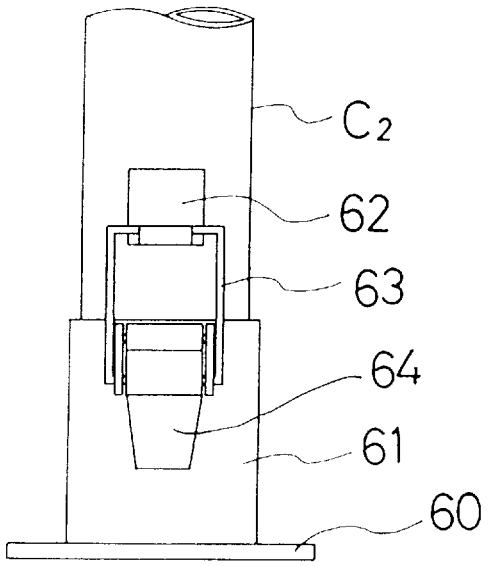
FIG. 34 is a front view of FIG. 33.

As shown in FIGS. 33 and 34, base plate 60 may be mounted on the under end of pole C2. Specifically, the under end of pole C2 is inserted into cylindrical body 61. By hooking engagement member 63 fixed on cylindrical body 61 to a hook 62 fixed on pole C2 and pulling down lever 64, base plate 60 is mounted to the under end of pole C2. The reference numeral 65 is a hole for an anchor bolt.

Figure 55:
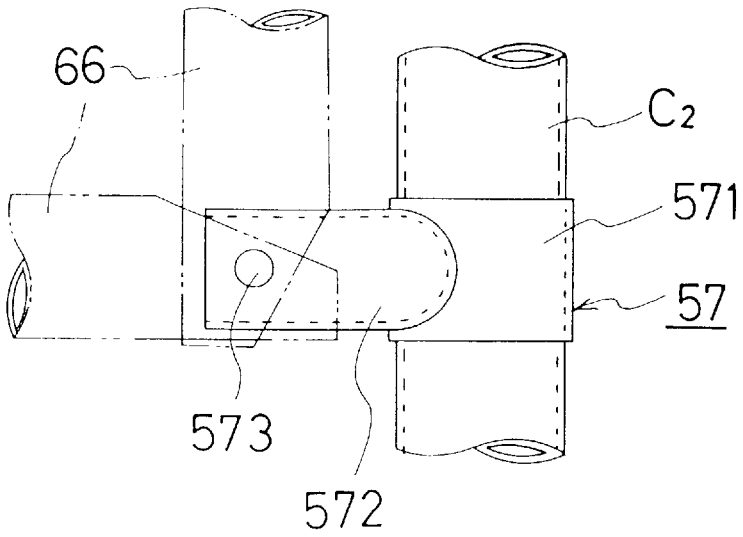
FIG. 55 is a front view of the mounting metals in FIG. 25.
Figure 56:
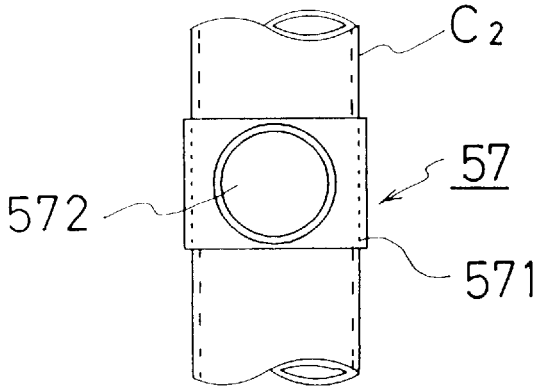
FIG. 56 is a left side view of FIG. 55.
Figure 57:
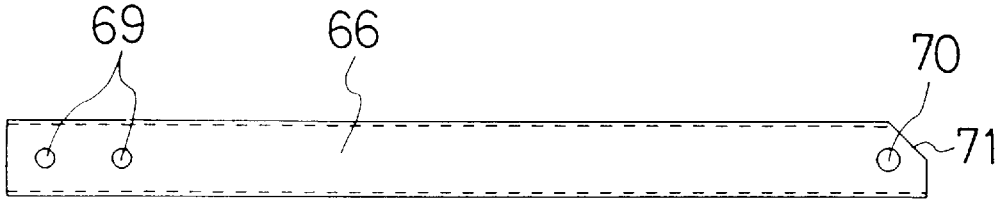
FIG. 57 is a plan view of a connecting beam mounted on the mounting metal provided on the bottom portion of the pole in FIG. 25.

Mounting metal 57 is provided on the under end of pole C2 as illustrated in FIG. 25. As shown in FIGS. 55 and 56, mounting metal 57 may be fixed by inserting pole C2 into fixed tube 571 on which connection tube 572 is provided. A connection beam 66 (shown in FIGS. 57–59) is provided that is larger in diameter than connection tube 572. Thus, connection beam 572 is adapted to be inserted into the connection tube 572. Additionally, one end of connection beam 66 has provided thereon mounting holes 69. The opposite end of connection beam 66 has provided thereon mounting pin hole 70 and slant cutout portion 71.

Figure 58:
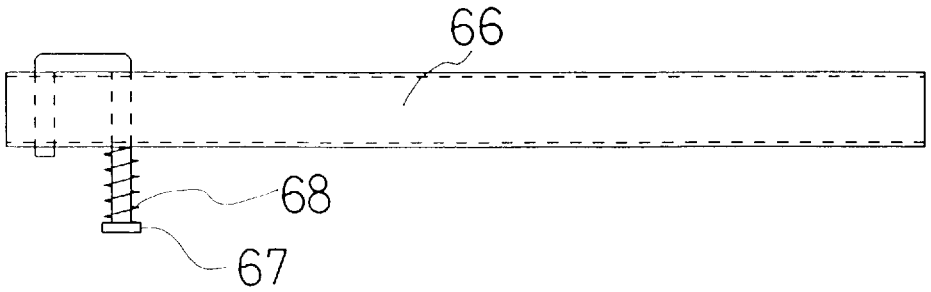
FIG. 58 is a front view of FIG. 57.
Figure 59:
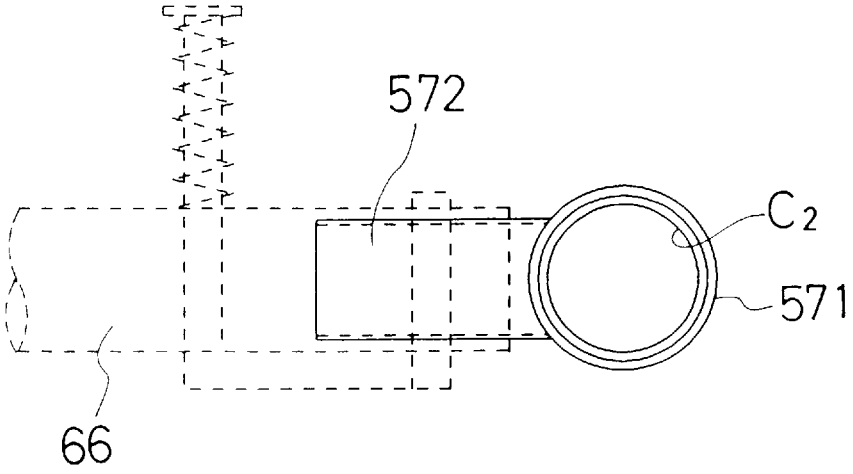
FIG. 59 is a front view showing the state in which the connecting beam of FIG. 57 is mounted to the pole.

Thus, due to slant cut out portion 71, connection beam 66 can be turned at right angles. That is, when mounting pin hole 70 and mounting hole 573 are connected by inserting connecting tube 573 to connection beam 66 and connected inserting a pin, connection beam 66 may be turned. Further, by installing fixed metal 67 to mounting hole 69, as shown in FIG. 58, the connection beam 66 and fixed metal 67 are connected, thereby resulting in one part, and reducing the risk of losing fixed metal 67.

Figure 60:
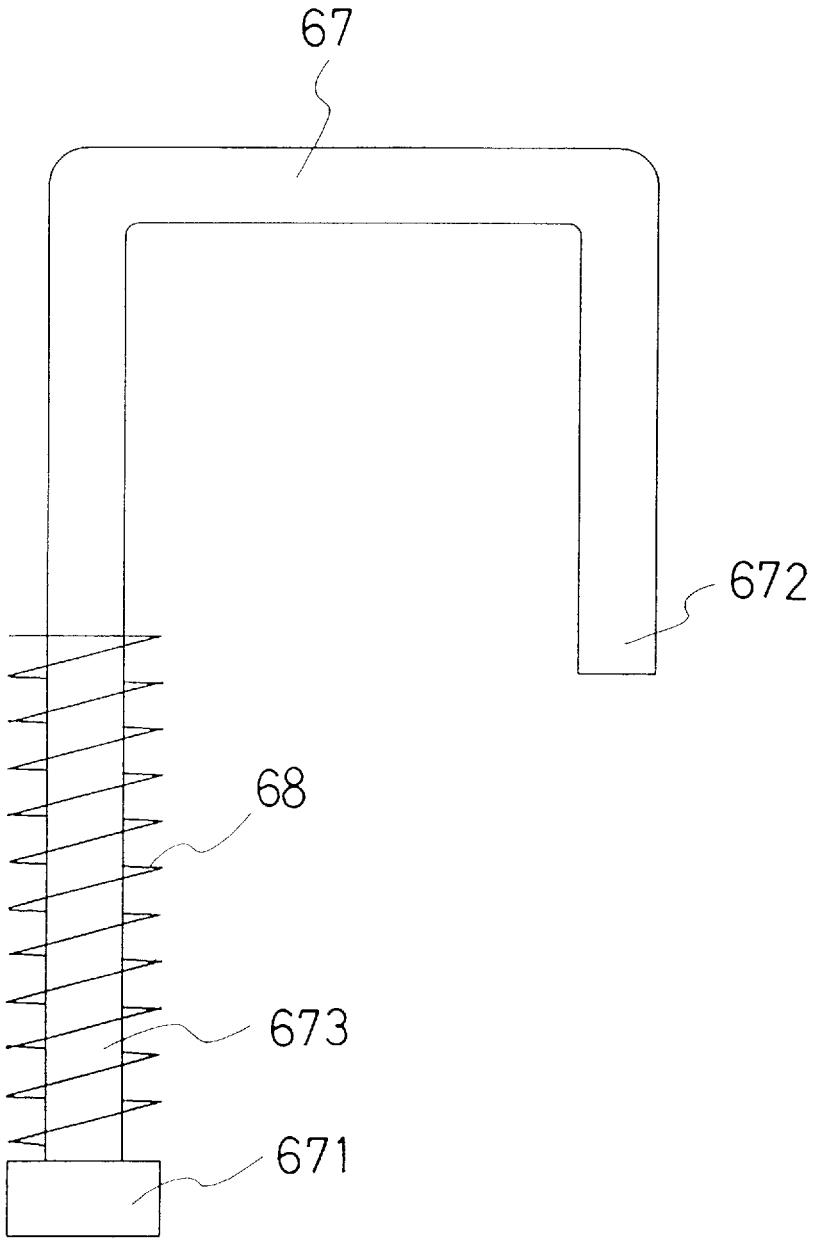
FIG. 60 is a front view of a fixing metal to mount the connecting beam shown in FIG. 57.
Figure 61:
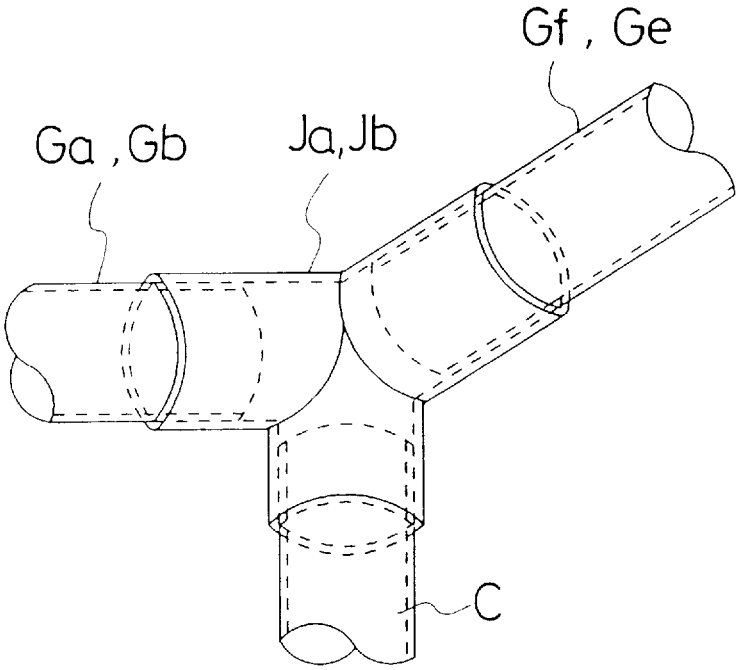
F I G. 61 (PRIOR ART)
FIG. 61 is a perspective view of a conventional joint.
Figure 62:
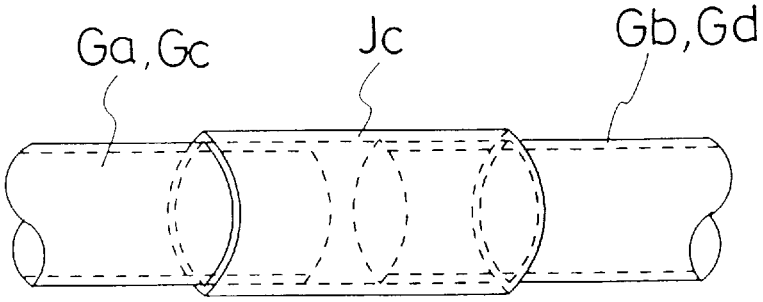
F I G. 62 (PRIOR ART)
FIG. 62 is a perspective view of a conventional joint.
Figure 63:
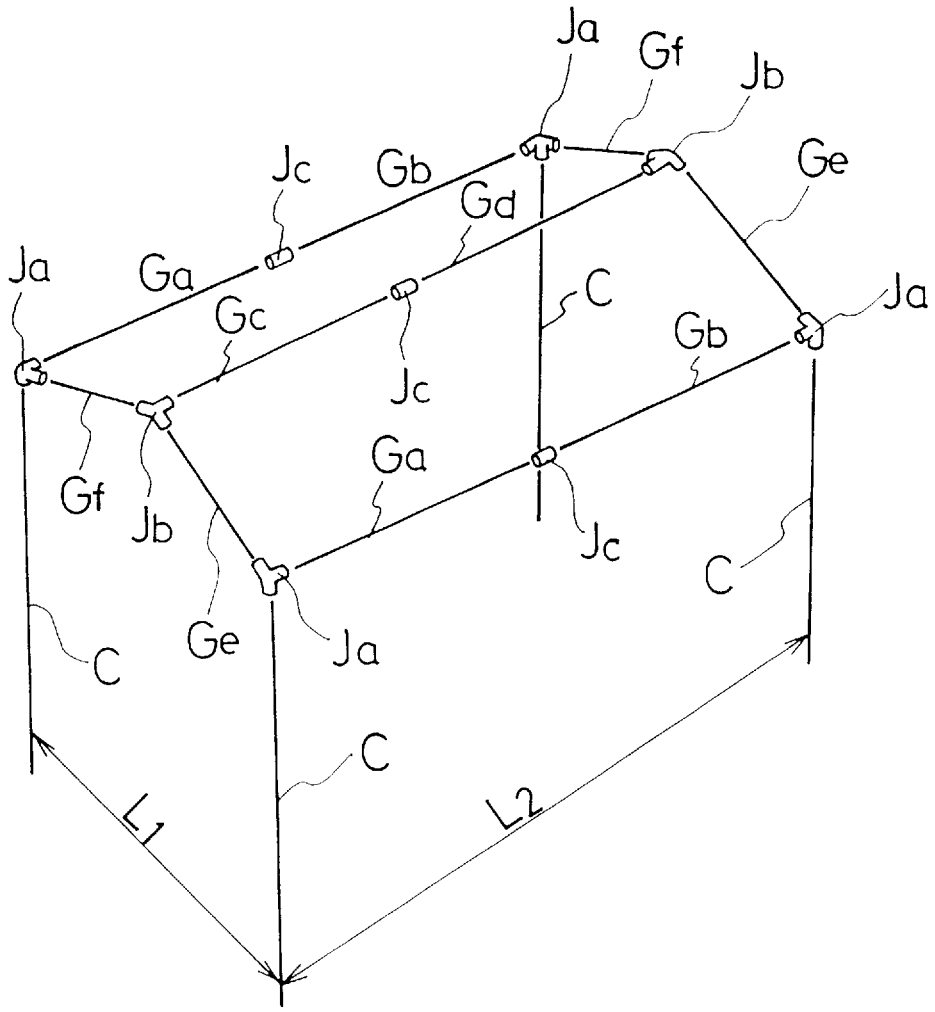
FIG. 63 (PRIOR ART)
FIG. 63 is a perspective view of a conventional framework for a building.

Connection beam 66 is connected to pole C2 by fixed metal 67. Specifically, fixed metal 67 may be pulled out from mounting hole 69 by compressing spring 68, thereby inserting connection tube 572 into connection beam 66. Then, when fixed metal 67 is released, the resiliency of the spring 68 causes fixed metal 67 to be inserted into mounting holes 69 and 573. In this manner, connection beam 66 is connected to pole C2. Fixed metal 67 is, as shown in FIG. 60, shaped as a U-letter form bent from a bar. End 672 of the fixed metal 67 is shorter than end 673. Fixed metal 67 is mounted on the connection beam 66 as shown in FIG. 58. Specifically, end 673 is inserted in mounting hole 69, spring 68 is installed, and nut 671 is screwed into end 673. Thus, connection beam 66 is optionally provided when extra rigidity is required for the framework.

As shown in FIG. 1, the tops of four poles C are connected with joint beams G1 and G2 and crossbeams G3 and G4 through joints J1 and J2. Joint beams G1 and G2 are connected through joint J3, ridge beams G5 and G6 are connected through joint J3, and ridge beams G5 and G6 are connected through joint J5. Finally, crossbeams G3 and G4 are connected through joint J4, and joint beams G1 and G2 and ridge beams G5 and G6 are connected through common joint J3. Joint beams G1 and G2 and crossbeams G3 and G4 are bendable downward through joints J3 and J4 in the direction of arrow (a) in FIG. 1 and arrow (b) in FIG. 2. Ridge beams G5 and G6 are bendable upward in the direction of arrow (c) in FIG. 2, so that the framework may be folded without disassembling as described hereinbelow.

Figure 3:
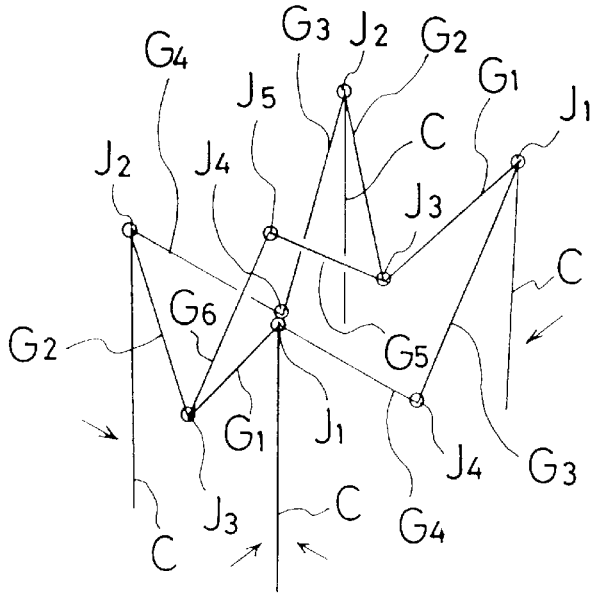
FIG. 3 is a perspective view of a framework for a building further folded from the state shown in FIG. 2.
Figure 4:
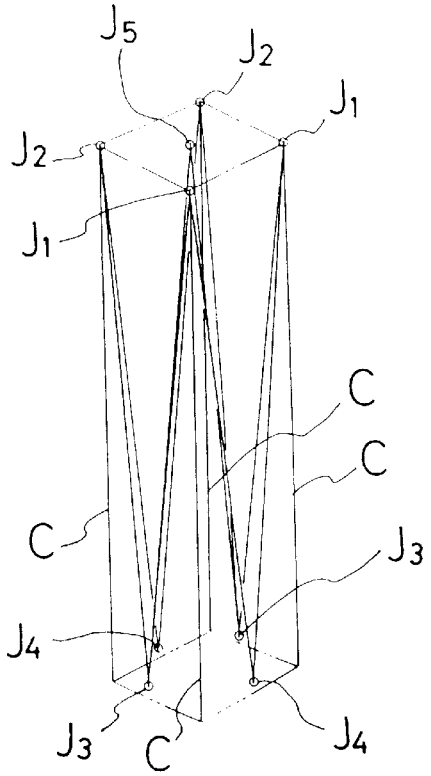
FIG. 4 is a perspective view of a framework for a building finally folded from the state of FIG. 1.

Specifically, joint J3 is bent downward in the direction of arrow (a) in FIG. 1, so that the span $L_1$ between poles C is shortened as shown in FIG. 2. Also as shown in FIG. 2, joint J4 can be bent downward in the direction of arrow (b), while joint J5 can be bent upward in the direction of arrow (c). In this manner, while the span $L_2$ between poles C is being shortened, the framework can be folded such that joint beams G1 and G2, crossbeams G3 and G4, ridge beams G5 and G6 and poles C are, as shown in FIG. 3, brought together. Thus, as shown in FIG. 4, the framework can be folded quadrilaterally positioning four poles C on a corner. Analogously, the framework may be constructed merely by separating four poles C.

Figure 5:
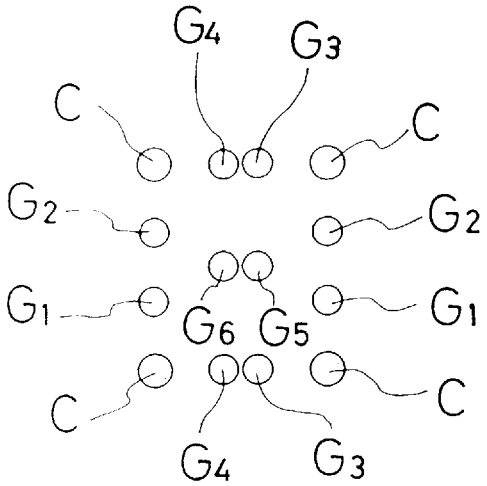
FIG. 5 is a sectional view of FIG. 4 showing the disposition relation of the poles and beams.

FIG. 5 shows a lateral sectional view of FIG. 4, in which the position where each pole and beam are brought together. As is shown, poles C are positioned at four corners, ridge beams G5 and G6 are located at the center of the structure, and joint beams G1 and G2 and crossbeams G3 and G4, respectively, are located at opposite sides and between poles C.

Figure 6:
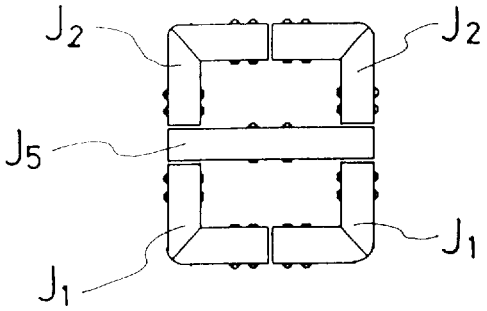
FIG. 6 is a plan view of the framework for a building folded.

Since joints J1 and J2 are coupled with reverse U-letter figured members 1 and 2, the rigidity at this connection of the framework is enhanced. Furthermore, since reverse U-letter figured members 1 and 2 are connected at right angles and joint beams G1 and G2 and crossbeams G3 and G4 are coupled to reverse U-letter figured members 1 and 2, the rigidity at this connection of the framework is enhanced. Finally, since the under portion of reverse U-letter figured members 1 and 2 is opened, as shown in FIG. 6, joint beams G1 and G2 and crossbeams G3 and G4 can be bent downward, resulting in the plane configuration of the folded framework being square and compact.

As shown in FIG. 13, the end portions of joint beams G1 and G2 and crossbeams G3 and G4 are coupled with reverse U-letter figured members 1 and 2. Reverse U-letter figured members are penetrated by pins 3 and 4. As shown in FIGS. 10 and 11, both sides of reverse U-letter figured members 1 and 2 have provided thereon long apertures 5 and 6 to guide pins 3 and 4. Long apertures 5 and 6, as the framework is being assembled, guide pins 3 and 4 such that the upper surfaces of joint beams G1 and G2 and crossbeams G3 and G4 maintain contact with bottom portions 101 and 201. Alternatively, when joint beams G1 and G2 and crossbeams G3 and G4 are bent downward, bent portions 502 and 602 guide pins 3 and 4 such that the end portions of joint beams G1 and G2 and crossbeams G3 and G4 separate from bottom portions 101 and 201 of reverse U-letter figured members 1 and 2.

Figure 7:
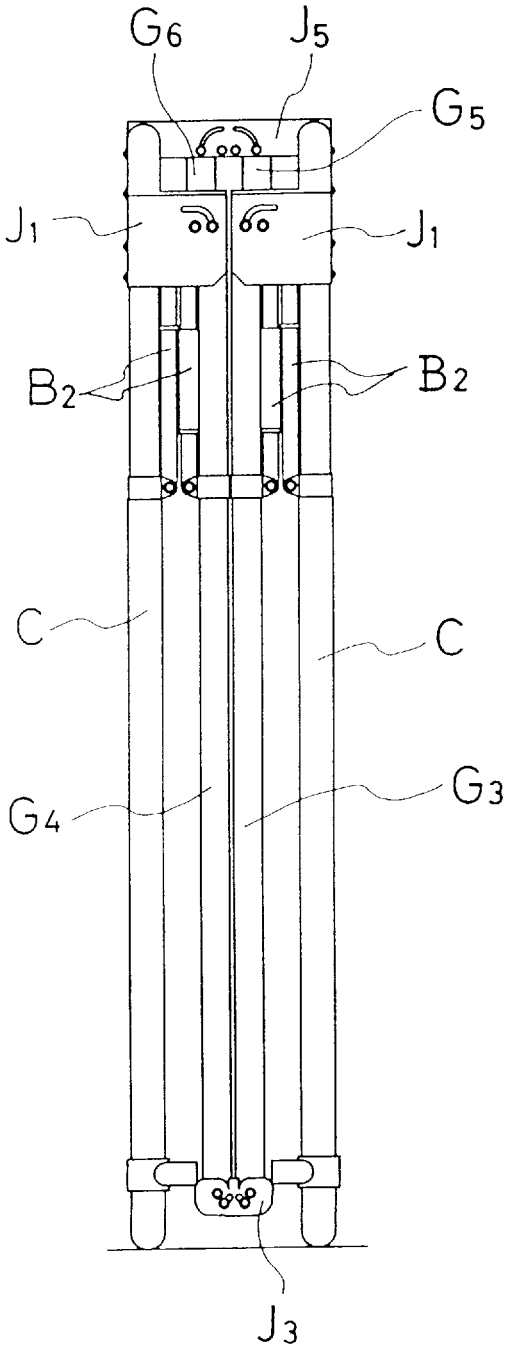
FIG. 7 is a front view of FIG. 6.
Figure 8:
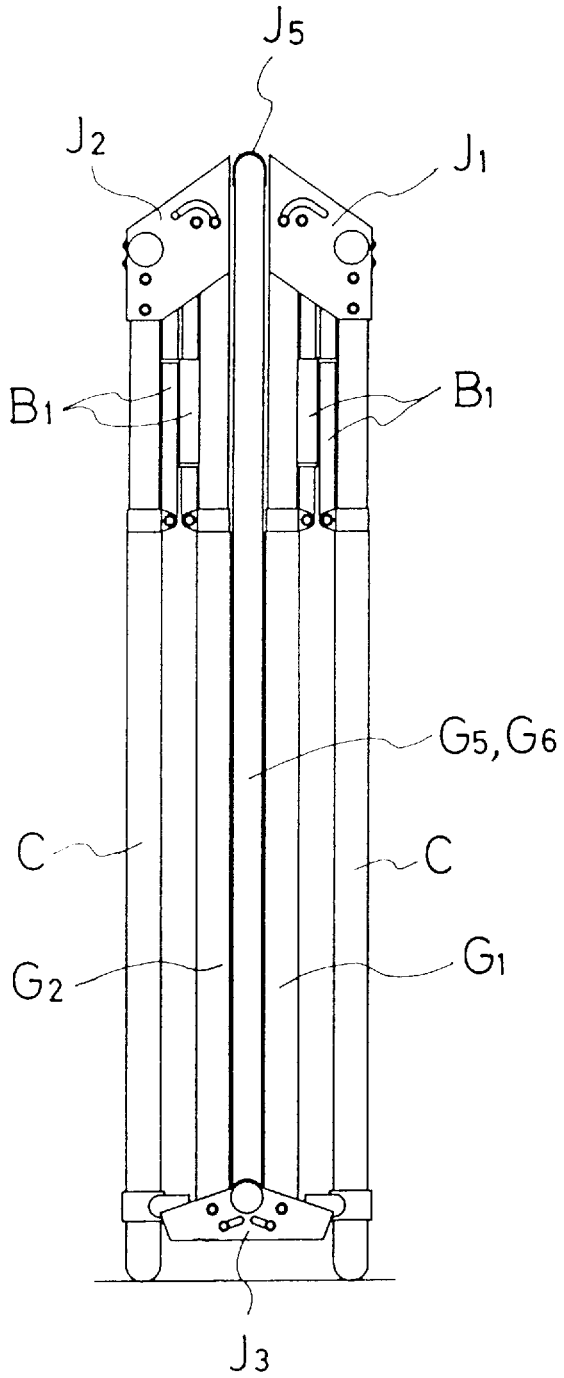
FIG. 8 is a side view of FIG. 7.

Thus, when the framework is assembled, the upper surfaces of joint beams G1 and G2 and crossbeams G3 and G4 are in contact with the inner side of the bottom portions 101 and 201 of the reverse U-letter figured members 1 and 2. Since pins 3 and 4 are located at parallel portions 501 and 601 of long apertures 5 and 6, the forces generated when joint beams G1 and G2 and crossbeams G3 and G4 are bent downward are absorbed by pins 3 and 4 and bottom portions 101 and 201, providing the framework with the desired rigidity. When pins 3 and 4 are displaced along the bent portions 502 and 602 of apertures 5 and 6, joint beams G1 and G2 and crossbeams G3 and G4 may be bent downward and the framework folded as shown in FIGS. 7 and 8.

Furthermore, tops of poles C are fixed to reverse U-letter figured member 2 in such a manner as poles C are arranged vertically downward against crossbeams G3 and G4. Thus, the tops of poles C and reverse U-letter figured member 2 are connected such that the rigidity of the framework is increased. In this manner, joint beams G1 and G2 and crossbeams G3 and G4 may be bent at joints J1 and J2 without removing reverse U-letter figured member 2 from the tops of poles C. Bending joint beams G1 and G2 and crossbeams G3 and G4 in this manner results in the framework being folded as shown in FIGS. 7 and 8.

As shown in FIGS. 10 and 11, when pins 3 and 4 are guided along parallel portions 501 and 601 of long apertures 5 and 6, the upper surfaces of joint beams G1 and G2 and crossbeams G3 and G4 maintain contact with bottom portions 101 and 201 of the reverse U-letter figured members 1 and 2. Since pins 7 and 8 penetrate reverse U-letter figured members 1 and 2, the under surfaces of joint beams G1 and G2 and crossbeams G3 and G4 maintain contact with pins 7 and 8. Thus, the ends of joint beams G1 and G2 and crossbeams G3 and G4 are clamped between pins 3 and 4 and pins 7 and 8. As a result, the forces generated when joint beams G1 and G2 and crossbeams G3 and G4 are bent downward are absorbed by bottom portions 101 and 201 and pins 7 and 8. In this manner, the assembled framework exhibits increased rigidity. Additionally, any horizontal distortion or three dimensional torsion that is applied to the framework may be absorbed by reverse U-letter figured members 1 and 2.

As shown in FIG. 19, joint J3 is formed with two plates 9 and 10 which, in turn, clamp two ends of joint beams G1 and G2 together. Plates 9 and 10 and the ends of joint beams G1 and G2 are connected with pin 11. Thus, joint beams G1 and G2 can be bent upward or downward. Additionally, joint beams G1 and G2 and pin 1, provide enhanced rigidity against any horizontal distortion or three dimensional torsion which acts to broaden plates 9 and 10.

Pin 13 is guided and displaced in long apertures 12 provided on plates 9 and 10. Specifically, when the ends of joint beams G1 and G2 pivot around pin 11, the ends of joint beams G1 and G2 change to abut or not to abut pin 13. When pin 13 is displaced along long apertures 12 and the ends of joint beams G1 and G2 abut pin 13, the bending of joint beams G1 and G2 is restricted. Also, the forces acting on joint J3 in the state of the assembled framework are absorbed by pins 11 and 13 to maintain the rigidity of framework. When pins 13 move along long apertures 12 and the ends of joint beams G1 and G2 do not abut to pin 13, joint beams G1 and G2 may be bent around joint J3.

As shown in FIG. 18, reverse U-letter figured member 14 is provided perpendicular to the sides of two plates 9 and 10. At the tip end of U-letter figured member 14 bottom portion 141 is cut out. Within cut out portion 15, the ends of ridge beams G5 and G6 may be bent so as to abut bottom portion 141 of reverse U-letter figured member 14. Joint beams G1 and G2 and ridge beams G5 and G6, may be connected with common joint J3. Since pin 17 penetrates cut out portion 15 and pin 17 is positioned to the inside of the framework from pin 32 by distance $L_3$, any forces generated when ridge beams G5 and G6 are bent may be absorbed by pins 11 and 17. Additionally, at this portion of joint J3, ridge beams G5 and G6 may be bent upward toward G5' and G6'.

Figure 23:
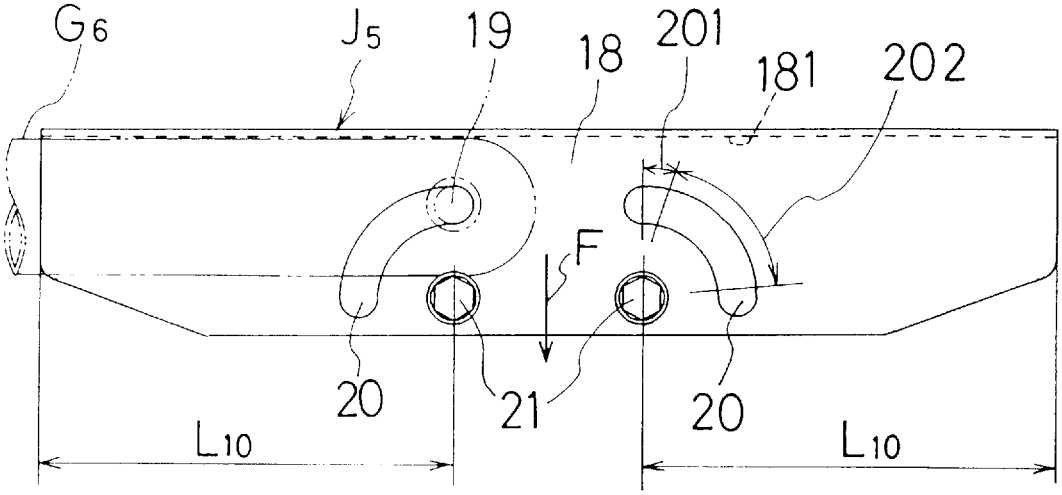
FIG. 23 is a front view of FIG. 22.
Figure 24:
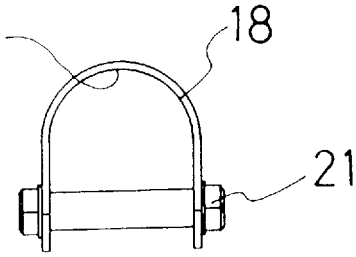
FIG. 24 is a side view of FIG. 23.

As shown in FIG. 23, at joint J5 of ridge beams G5 and G6, the ends of ridge beams G5 and G6 are corrected to reverse U-letter figured member 18 with pins 19. Specifically, pins 19 penetrate reverse U-letter figured member 18, so that the rigidity of the framework is increased by the unification of ridge beams G5 and G6. Both sides of reverse U-letter figured member 18 have provided thereon long apertures 20 to guide pin 19. Long apertures 20 comprise parallel portion 201 and bent portion 202. When ridge beams G5 and G6 are horizontal, long apertures 20 guide pin 19 such that the upper sides of ridge beams G5 and G6 maintain contact with the inside of bottom portion 181 of reverse U-letter figured member 18. When ridge beams G5 and G6 are bent at joint J5, bent portion 202 guides pin 19 such that the ends of ridge beams G5 and G6 separate from bottom portion 181 of reverse U-letter figured member 18. At joint J5, bottom portion 181 and pin 19 absorb any forces generated due to the bending of ridge beams G5 and G6. Additionally, the configuration of reverse U-letter figured member 18 and pin 19 prevent ridge beams G5 and G6 from being bent downward, while allowing ridge beams G5 and G6 to be bent upward.

When pin 19 is guided along horizontal portion 201 of long aperture 20 the upper sides of ridge beams G5 and G6 maintains contact with bottom portion 181 of reverse U-letter figured member 18. When pin 19 is so guided, pin 21 absorbs any forces generated by the bending of ridge beams G5 and G6. Specifically, pin 21 is in contact with the under side of ridge beams G5 and G6 and penetrates reverse U-letter figured member 18. In this manner at joint J5, any forces generated due to the bending of ridge beams G5 and G6 are absorbed by bottom portion 181 and pin 21, thus increasing the rigidity of this portion of the framework. Additionally, any horizontal distortion or the three dimensional torsion is also absorbed by pin 21. Thus, the rigidity of reverse U-letter figured member 18 is increased.

As shown in FIG. 21, the ends of crossbeams G3 and G4 are coupled with reverse U-letter figured member 22. Specifically, the bottom portion 221 of reverse U-letter figured member 22 is cut out partially and each end of crossbeams G3 and G4 is connected within the cut-out portion of pin 24. In this manner, reverse U-letter figured member 22 and crossbeams G3 and G4 are unified and the rigidity of the framework is increased. When crossbeams G3 and G4 do not abut bottom portion 221, crossbeams G3 and G4 may be bent, e.g., at joint J4, to G4'. Pin 26 is provided, which is guided and displaced in long apertures 25 provided on the sides of the reverse U-letter figured member 22. When crossbeams G3 and G4 pivot around pin 24, the ends of crossbeams G3 and G4 move so as to engage or disengage with pin 26. When the ends of crossbeams G3 and G4 are abutted to pin 26, crossbeams G3 and G4 may not be bent downward. Analogously, when the ends of crossbeams G3 and G4 are displaced from pin 26, crossbeams G3 and G4 may be bent downward. Any forces generated due to the downward force applied to joint J4 may be absorbed by pins 24 and 26, further enhancing the rigidity of the framework.

Figure 52:
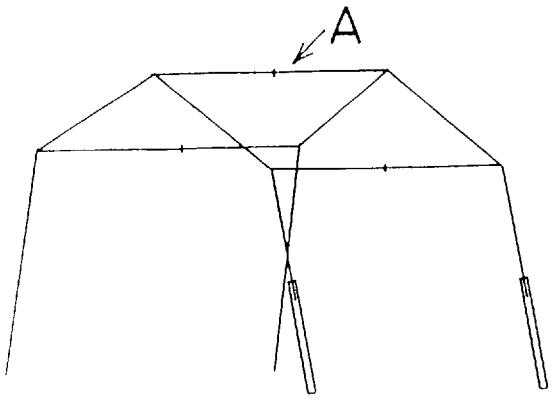
FIG. 52 is a schematic diagram of the use manner of the framework for a building show in FIG. 1.
Figure 53:
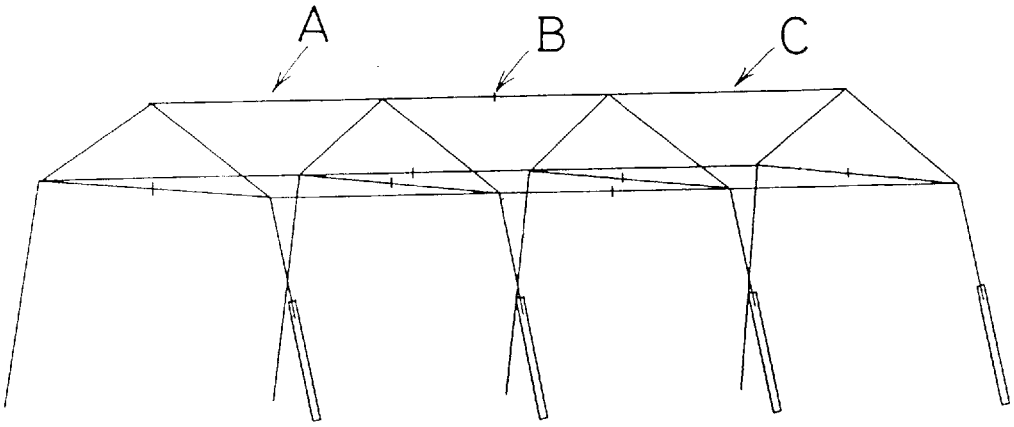
FIG. 53 is a schematic diagram of the use manner of the framework for a building shown in FIG. 1.
Figure 54:
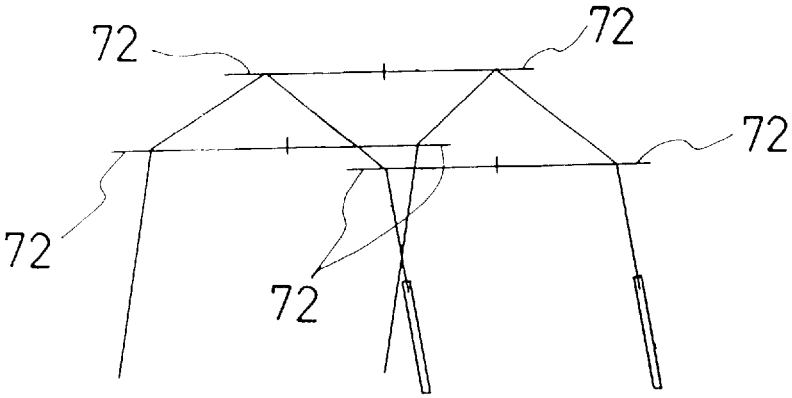
FIG. 54 is a schematic diagram of the use manner of the framework for a building shown in FIG. 1.

As shown in FIG. 12, through hole 28 is provided in joints J1 and J2. As shown in FIG. 18, reverse U-letter figured member 14 penetrates two plates 9 and 10. Joint J3 connects the ends of crossbeams G3 and G4. Additionally, crossbeams G3 and G4 are penetrated at joints J1 and J2. Joint J3 penetrates ridge beams G5 and G6. Thereby, as shown in FIG. 52, one framework for a building may be constructed, or, as shown in FIG. 53, a plurality of frameworks A, B and C may be connected or, as shown in FIG. 54, eaves 72 may be formed.

As shown in FIG. 25, one end of brace B1is fixed to pole C1 with mounting metal 41. The opposite end of brace B1is removably attached to joint beams G1 and G2 with mounting metal 42. As shown in FIG. 26, one end of brace B2 is fixed to pole C1 with mounting metal 41, while the opposite end of brace B2 is removably attached to crossbeams G3 and G4 with mounting metal 46. Similarly, one end of brace B3 is fixed to joint beams G1 and G2 with mounting metal 49 while the opposite end of B3 is removably attached to crossbeams G3 and G4 with mounting metal 48. Finally, one end of brace B4 is fixed to joint beam G1 with pin 54 while the opposite end of brace B4 is removably attached to joint beam G2 with mounting metal 55. Each brace B1, B2, B3, and B4 may be bent, so that the framework may be folded without disassembling any of braces B1, B2, B3 and B4, as shown in FIGS. 7 and 8.

Although the above explanation is specific to the embodiment where pipe members are used for joint beams G1 and G2, crossbeams G3 and G4, ridge beams G5 and G6, and poles C, the function is identical in the embodiment where square bars or section steel are used. Since joints Jl, J2, J3, J4 and J5 are formed from reverse U-letter figured members and the shape of both sides of the reverse U-letter figured members is identical, each joint may be manufactured from metal in the same manner, and thus many joints may be produced at one time. Further, joints J1, J2, J3, J4 and J5 may be made of hard resin, for which embodiment a mold may be easily prepared.

Thus, in one embodiment of the present invention, the tops of four poles are connected with two parallel joint beams and two parallel crossbeams through joints. The two joint beams are divided in two and the center portions of the two joint beams are connected with ridge beams through the joints. The two ridge beams are divided into two and connected through the joints and the joint beams and ridge beams are connected with common joints. The divided joint beams and crossbeams are bendable downward through each joint, while the ridge beams are bendable upward through each joint. When the pole and each beam are connected in this manner, the framework may be folded by bending downward the two divided joint beams and crossbeams through each joint. If, when the framework is so folded, the ridge beam is bent upward, the length of the folded framework may be shortened. Thus, the rigidity of the framework is maintained, yet the framework is also light-weight.

Further, since, the framework can be structured and folded while the poles and each beam are connected through the joints, no parts need to be separated, and thus the possibility of losing any part is lessened, the amount of parts to be handled is minimized, and the folded framework is easily stored.

In a second embodiment of the invention, the joint portions connect the ends of the joint beams and the crossbeams with two reverse U-letter figured members. Specifically, the joint beams and the crossbeams are connected at right angles to the plane of the framework. Additionally, each of the reverse U-letter figured member's is formed in accordance with the outer shape of the joint beam and the crossbeam, thereby enhancing the rigidity of the framework at the junction of the joint beams and the crossbeams. This design allows the framework to be assembled, folded, and stored easily.

Also, in this embodiment of the invention, the ends of the joint beams and the crossbeams are connected with the reverse U-letter figured member. The reverse U-letter figured member is penetrated with a pin and has provided on both sides thereof long apertures for guiding the pin. The long apertures comprise parallel portions which are parallel to the insides of the bottom portions of the reverse U-letter figured member. When the framework is assembled as a building, the parallel portions of the long aperture guide the pin such that the upper sides of the joint beams and the crossbeams are in contact with the insides of the reverse U-letter figured member. The long apertures of the reverse U-letter figured member further comprise bent portions, which guide the pin such that the ends of the joint beams and the crossbeams separate from the bottom portions of the reverse U-letter figured member when the ends of thejoint beams and the crossbeams are bent downward. When the framework is assembled, the upper sides of the joint beams and the crossbeams are in contact with the insides of the bottom portions of the reverse U-letter figured member and the pin is located at the parallel portion of the long apertures. In this manner, the framework displays rigidity against a force to bend the joint beams and the crossbeams downward. In addition, when the pin is displaced along the bent portions of the long apertures, displacing the joint beams and the crossbeams, the joint beams and the cross beams can be bent downward without removing the joint beams and the cross beams from the reverse U-letter figured member. Thus, the assembly, folding and storage of the framework is rendered easy.

Additionally, when the tops of the poles are fixed on the reverse U-letter figured member so that the poles are vertical, the rigidity between the poles and the reverse U-letter figured member is increased. When the reverse U-letter figured member is attached to the poles, the joint beams and the crossbeams can be bent at the joint portion, so that assembly, folding and storage of the framework is easy.

In yet another embodiment of the invention, when the upper surfaces of the joint beams and the crossbeams are in contact with the bottom portion of the reverse U-letter figured member by virtue of the pin being guided along the long apertures, pins are provided which are in contact with the under surfaces of the joint beams and the crossbeams that penetrate the reverse U-letter figured member. Thus, when the framework is assembled, the upper surfaces of the edges of the joint beams are in contact with the bottom portion of the reverse U-letter figured member and the under surfaces thereof are in contact with the pins penetrating the reverse U-letter figured member. In this manner, the ends of the joint beams and the crossbeams are clamped, thus providing the reverse U-letter figured member itself and the framework with enhanced rigidity. In addition, the framework may be assembled and folded without removing the reverse U-letter figured member and thus, assembly, folding and storage of the framework are easy.

In another embodiment of the present invention, the joints, where the ends of two divided joint beams and the ends of the ridge beam are connected, are formed by clamping the ends of two divided joint beams with two plates. The ends of the joint beams and plates are penetrated with a pin. Additionally, the two divided joint beams are capable of being bent upward or downward, so that, even though the rigidity of the joint is increased, the joint beams can be bent without removing them from the joint. In this manner, assembly, folding and storage of the framework is easy.

Additionally, another pin may be provided, which is inserted and displaced in the long apertures provided on both sides of the aforementioned two plates. The ends of the joint beams either engage or disengage with this pin when the joint beams are made to pivot about the pin. When the ends of the joint beams engage with the pin, the bending of the joint beams is restricted, thereby providing rigidity in this portion of the framework. When the pin in the aperture is displaced and the ends of the joint beams do not engage with the pin, the joint beams may be sent, so that without removing the joint beams from the joint, the framework can be assembled, folded or stored easily.

Also in this embodiment of the invention a reverse U-letter figured member is provided perpendicular to the sides of two plates. At the end of the reverse U-letter figured member, a portion of the bottom is cut out. The end of the ridge beams are connected within to the cut-out portion with a pin. Thus, since the joint beams and the crossbeams are connected with a common joint, the joint beams may be bent downward and the ridge beams bent upward without removing the joint. Further, a pin is provided that penetrates through this cut out portion, this pin being in contact with the under side of the ridge beam in a horizontal position. Additionally, this pin is located at a position more toward the inside of the framework than the pin which connects the ridge beam. In this manner, the inside pin absorbs the force applied to bend the ridge beam downward. Additionally, the ridge beam may also be bent upward at this joint, without removing the joint. In this manner, the framework may be assembled, folded or stored easily.

In another embodiment of the present invention, the joint portion of two divided ridge beams is coupled with the reverse U-letter figured member. Additionally, a pin penetrates the reverse U-letter figured member, thereby increasing the rigidity of this connection. In this manner, the divided ridge beams may be bent. Additionally, long apertures are provided on both sides of the reverse U-letter figured member that act to guide the pin. These long apertures comprise parallel portions that are parallel to the bottom portion of the reverse U-letter figured member and bent portions. The parallel portions guide the pin such that the upper surface of the ridge beam, in its horizontal position, is in contact with the inside of the bottom portion of the reverse U-letter figured member. The bent portions guide the pin such that, when the ridge beam is bent at the joint, the end of the ridge beam separates from the bottom portion of the reverse U-letter figured member. This joint also prevents the ridge beam from being bent downward while allowing the ridge beam to be bent upward. In this manner, the framework may be assembled and folded without removing the joint. Thus, the assembly, folding and storage of the framework may be easily accomplished.

In another embodiment of the present invention, a pin is provided which contacts the under surface of the ridge beam and penetrates the reverse U-letter figured member. In this manner, when the pin is guided along the parallel portion of the long aperture and the upper surface of the ridge beam is in contact with the bottom portion of the reverse U-letter figured member, the rigidity of the framework against the force to bend downward is increased. Also, the rigidity of the reverse U-letter figured member itself is increased, and thus, the rigidity of the overall framework is increased.

In yet another embodiment of the present invention, the ends of two divided crossbeams are coupled with the reverse U-letter figured member. At these coupled portions, a bottom portion of the reverse U-letter figured member is cut out. Within these cut-out portions, each end of the crossbeam is connected with a pin, so that the two divided crossbeams are bendable. Additionally, a pin is provided which is displaced along the long apertures provided on both sides of the reverse U-letter figured member. Specifically, the pin is displaced such that when the crossbeams pivot around the pin, the ends of the crossbeams change to engage or not engage with the pin. When the ends of the crossbeams are engaged with the pin, the downward bending of the crossbeams are prevented. When the ends of the crossbeams do not engage with the pin, the crossbeams are bendable downward. In this manner, the framework may be assembled, folded and stored without removing the joint.

What is claimed is:

1. A framework for a small-scale building comprising:

four poles;

two joint beams;

two crossbeams; and a ridge beam;

wherein:

a top end of each of the four poles is connected to a joint beam and a crossbeam by way of a first joint, each of the joint beams is divided into joint beam portions at a joint beam intermediate point and each joint beam portion is connected at said joint beam intermediate point by way of a second joint, the ridge beam is divided into ridge beam portions at a ridge beam intermediate point and each ridge beam portion is connected at said ridge beam intermediate point by way of a third joint, and the ridge beam is also connected between the joint beams by way of the second joints, each of the crossbeams is divided into crossbeam portions at a crossbeam intermediate point and each crossbeam portion is connected at a crossbeam intermediate point with a fourth joint, and wherein the joint beams are bendable at the second joint by movement of the second joint in a first direction, the crossbeams are bendable at the fourth joint by movement of the fourth joint in the first direction, and the ridge beam is bendable at the third joint by movement of the third joint in a second direction.

2. The framework of claim 1, wherein said first joints comprise:

first and a second reverse U-letter figured members combined at right angles with each other and in accordance with the shape of the framework as defined by a joint beam and a crossbeam, each reverse U-letter figured member of a first joint comprising a first side and a second side, wherein the first side and second side have provided thereon long apertures which comprise a curved portion and a straight portion;

wherein:

an end of a joint beam is connected to one of the reverse U-letter figured members of a first joint by a first pin passing through the end of the joint beam and guided within the long apertures of the one reverse U-letter figured member;

an end of a crossbeam is connected to the other one of the reverse U-letter figured members of the first joint by a second pin passing through the end of the crossbeam and guided within the long apertures of the other reverse U-letter figured member; and the top end of a pole is connected to one of the reverse U-letter figured members of the first joint so as to be vertically disposed relative to the crossbeam, so that, the first and second pins are in the straight portions of the long apertures of their respective reverse U-letter figured member when an upper surface of the joint beam and an upper surface of the crossbeam are in contact with an inside bottom portion of the reverse U-letter figured members, and the first and second pins are in the curved portions of the long apertures of their respective reverse U-letter figured member when the joint beam and the cross beam are separated from the bottom portion of the reverse U-letter figured members, whereby the joint beam is bendable at the second joint by movement of the second joint in the first direction, and the crossbeam is bendable at the fourth joint by movement of the fourth joint in the first direction.

3. The framework of claim 2, wherein said first joints further comprise a third pin supported by the first and second sides of each reverse U-letter figured member, wherein, when the first and second pins are in the straight portion of the long apertures of their respective reverse U-letter figured member and the upper surfaces of the joint beam and the crossbeam are in contact with the bottom portion of their respective reverse U-letter figured member, each third pin is positioned so as to be in contact with an under surface of one of the joint beam and the crossbeam.

4. The framework of claim 1, wherein the second joints comprise:

a pair of spaced plates connected between intermediate ends of the joint beam portions by way of a pair of fourth pins, each fourth pin passing through one end of a joint beam portion and the pair of spaced plates such that the joint beam portions may pivot around the fourth pins; and a third reverse U-letter figured member connected to and positioned so as to be perpendicular to the spaced plates, said third reverse U-letter figured member also having a cut-out portion at a distal end of a bottom portion of the reverse U-letter figured member, wherein:

each of the spaced plates includes a pair of long apertures within which fifth pins that also extend between the spaced plates are slidably received, said fifth pins being movable along the long apertures between positions for selectively permitting and preventing pivoting of a joint beam portion about its fourth pin, and adjacent to said cutout portion of the reverse U-letter figured member an end of the ridge beam is pivotally coupled to the reverse U-letter figured member by a sixth pin, and in a state where said ridge beam is horizontal, a seventh pin that is also supported between sides of the reverse U-letter figured member can contact with an under surface of the ridge beam, the position of the seventh pin being further from the spaced plates than the sixth pin.

5. The framework of claim 1, wherein the third joints each comprise:

a fourth reverse U-letter figured member comprising a first side and a second side, wherein the first side and second side of the reverse U-letter figured member have provided thereon a pair of long apertures which each comprise a curved portion and a straight portion, and wherein:

an end of each of the ridge beam portions is pivotally connected to the reverse U-letter figured member by an eighth pin passing through the end of each ridge beam portion and which is guided within an opposed set of the long apertures of the first and second sides of the reverse U-letter figured member;

so that, each eighth pin can be positioned in the straight portion of its set of long apertures of the reverse U-letter figured member with an upper surface of a ridge beam portion is in contact with an inside bottom portion of the reverse U-letter figured member, and each eighth pin can be positioned in the curved portion of its set of long apertures of the reverse U-letter figured member with a ridge beam portion separated from the inside bottom portion of the reverse U-letter figured member so that the ridge beam is bendable at the third joint by movement of the third joint in the second direction.

6. The framework of claim 5, further comprising a pair of ninth pins supported and positioned by the first and second sides of the reverse U-letter figured member, so that when the eighth pins are in the straight portions of the long apertures of the reverse U-letter figured member and the upper surface of the ridge beam portions are in contact with the inside bottom portion of the reverse U-letter figured member, each ninth pin is positioned so as to be in contact with an under surface of a ridge beam portion.

7. The framework of claim 1, wherein the fourth joints each comprise:

a fifth reverse U-letter figured member comprising a first and a second side, which first and second sides each comprise a pair of long apertures, said fifth reverse U-letter figured member also having cut-out portions at both ends of a bottom portion of the reverse U-letter figured member;

wherein intermediate ends of the crossbeam portions are pivotally connected to the fifth reverse U-letter figured member by a pair of tenth pins each of which passes through an end of a crossbeam portion and the first and second sides of the fifth reverse U-letter figured member at a point adjacent to one of the cut-out portions thereof, and a pair of eleventh pins are provided to be moveable within an opposed set of long apertures of the first and second sides of the fifth reverse U-letter figured member, said eleventh pins being movable along the long apertures between positions for selectively permitting pivoting of crossbeam portions about its tenth pin.

* * * * *